US011042121B2

(12) United States Patent
Bozovic et al.

(10) Patent No.: US 11,042,121 B2
(45) Date of Patent: Jun. 22, 2021

(54) INDICATION DEVICE

(71) Applicant: Preciflex SA, Neuchâtel (CH)

(72) Inventors: Gavrilo Bozovic, Lausanne (CH); Johann Rohner, Yverdon (CH); Alain Jaccard, Ste-Croix (CH); Nicolas Bartholomé Nussbaumer, Neuchâtel (CH); Manuel Romero, Neuchâtel (CH); Yves Ruffieux, St-Aubin (CH); Gregory Dourde, Neuchâtel (CH); Noelia L. Bocchio, Lausanne (CH); Lucien Vouillamoz, Feusisberg (CH)

(73) Assignee: PRECIFLEX SA, Neuchâtel (CH)

( * ) Notice: Subject to any disclaimer, the term of this patent is extended or adjusted under 35 U.S.C. 154(b) by 0 days.

(21) Appl. No.: 15/564,771

(22) PCT Filed: Apr. 7, 2016

(86) PCT No.: PCT/IB2016/000448
§ 371 (c)(1),
(2) Date: Oct. 6, 2017

(87) PCT Pub. No.: WO2016/162745
PCT Pub. Date: Oct. 13, 2016

(65) Prior Publication Data

US 2018/0196391 A1 Jul. 12, 2018

Related U.S. Application Data

(60) Provisional application No. 62/143,904, filed on Apr. 7, 2015.

(30) Foreign Application Priority Data

Apr. 7, 2015 (WO) ..... PCT/IB2015/000446
Apr. 7, 2015 (WO) ..... PCT/IB2015/000448

(51) Int. Cl.
*G04F 13/06* (2006.01)
*G04B 1/26* (2006.01)
(Continued)

(52) U.S. Cl.
CPC ..... *G04B 1/265* (2013.01); *G04B 19/00* (2013.01); *G04C 17/00* (2013.01); *G04F 13/06* (2013.01)

(58) Field of Classification Search
CPC ..... G04B 19/00; G04B 39/02; G04B 1/265; G04C 17/00; G04F 13/06
(Continued)

(56) References Cited

U.S. PATENT DOCUMENTS 3,486,109 A * 12/1969 Schmidt ..... G04G 9/065 324/94
4,228,649 A * 10/1980 Weiss ..... G04F 1/08 368/93
(Continued)

FOREIGN PATENT DOCUMENTS

FR 1552838 A 1/1969
WO WO2011/021098 A1 2/2011

OTHER PUBLICATIONS

Hall Sensor—wikipedia.com May 4, 2020.*
International Search Report, International patent application No. PCT/IB2016/000448, dated Apr. 7, 2016.

*Primary Examiner* — Sean Kayes
(74) *Attorney, Agent, or Firm* — Da Vinci Partners LLC; John Moetteli

(57) ABSTRACT

An indication device is provided. The indication device includes an elongated fluid chamber containing at least one electrically conductive liquid driven by a pump for conductive liquids and an immiscible, relatively non-conductive fluid. At least one segment of at least one fluid is used as an indicator. This segment is driven by the pump along adjacent
(Continued)

indices of an indicator visible to an observer using a meniscus location sensor and a feedback controller so as to e.g indicate a quantity to the observer.

84 Claims, 23 Drawing Sheets

(51) Int. Cl.
*G04C 17/00* (2006.01)
*G04B 19/00* (2006.01)

(58) Field of Classification Search
USPC ..... 368/327
See application file for complete search history.

(56) References Cited

U.S. PATENT DOCUMENTS 5,176,030 A 1/1993 Laughlin
5,665,912 A 9/1997 Laughlin
7,016,562 B2 3/2006 Ticknor et al.
7,283,696 B2 10/2007 Ticknor et al.
8,381,598 B2 2/2013 Achard et al.
8,562,305 B2 10/2013 Bau
8,920,376 B2 12/2014 Caffey et al.
8,995,237 B2 * 3/2015 Vouillamoz ..... G04B 1/265 368/223
2009/0219789 A1 * 9/2009 Meadows ..... G04B 19/00 368/223
2012/0147713 A1 * 6/2012 Vouillamoz ..... G04B 1/265 368/223
2012/0263022 A1 * 10/2012 Grize ..... G04B 19/00 368/226
2016/0133345 A1 * 5/2016 Vouillamoz ..... G04B 1/265 116/200
2017/0235278 A1 * 8/2017 Vouillamoz ..... G04B 19/00 368/65

* cited by examiner 300
1244
1246
Z'-Z
N
S
+I
-I

Z
1252
1248
1244
B'
Z'
X'
A'
A
X
B 1256
1258
A'-A
1260

1262
1264
X'-X

B'-B

INDICATION DEVICE

CROSS REFERENCE TO RELATED APPLICATIONS

This application is the National Stage of International Application No. PCT/IB2016/000448, filed Apr. 7, 2016, which claims benefit under 35 USC § 119(a), to U.S. provisional patent application Ser. No. 62/143,904, filed Apr. 7, 2015, to the International patent application Ser. No. PCT/IB2015/000448, filed Apr. 7, 2015, and to the International patent application Ser. No. PCT/IB2015/000446, filed Apr. 7, 2015.

COPYRIGHT & LEGAL NOTICE

A portion of the disclosure of this patent document contains material which is subject to copyright protection. The Applicant has no objection to the facsimile reproduction by anyone of the patent document or the patent disclosure as it appears in the Patent and Trademark Office patent file or records, but otherwise reserves all copyright rights whatsoever. Further, no references to third party patents or articles made herein are to be construed as an admission that the present invention is not entitled to antedate such material by virtue of prior invention.

BACKGROUND OF THE INVENTION

This invention relates to systems and methods for jewelry such as timepieces with fluid indication in a transparent cavity or in channels, more particularly in a wristwatch.

Luxury watches exist that indicate time using a meniscus of a liquid which is driven by a purely mechanical system. Such watches are complicated and, consequently, very expensive. A need therefore exists for a low cost watch that accurately indicates time using electronic means to displace the meniscus of a liquid.

SUMMARY OF THE INVENTION

The invention provides a system for a device suitable for embellishing jewelry or indicators as e.g. dashboards. The system for a device includes a channel fillable with one or more fluids. The individual fluids are preferable immiscible with each other. Each individual fluid can be transparent or colored, may have the same refractive index as the substrate (e.g. bore glass), can optionally contain solid particles, can be electrically conductive or electrically non-conductive, while at least one liquid must be electrically conductive. In a variant, the indication is done with a moving gas bubble, such as a radioactive tritium gas. The channel is formed as a closed loop or in a variant formed with ends ending in a reservoir. An electrically conductive liquid (e.g., a salt solution or an ionic liquid) can be moved with the channel by the means of one or more magnetohydrodynamic pumps (MHD pumps). In a further variant, a second fluid is electrically non-conductive or electrically conductive, this fluid is pushed or pulled by the electrically conductive liquid driven by the MHD pump(s).

In a variant, the MHD pump(s) is/are driven in DC-mode, i.e. a magnetic field originated by the magnets does not change its polarity over time, and an electric field originated by the electrodes does not change its polarity over time.

In a variant, the MHD pump(s) is/are driven in AC-mode, i.e. a magnetic field originated by the magnets, particularly electro magnets, does change its polarity over time, and an electric field originated by the electrodes does change its polarity over time. The change of polarity of the magnetic field and the change of polarity of the electric field are essentially synchronized.

In a variant, the MHD pump(s) is/are driven in a combined mode, i.e. a magnetic field originated by the magnets does optionally change its polarity over time, and an electric field originated by the electrodes does optionally change its polarity over time. The optional change of polarity of the magnetic field and the optional change of the electric field may be synchronized or not synchronized.

In a variant, the position of the electrically non-conductive or electrically conductive fluid, in a variant embodied as a gas bubble, within the channel is sensed along the channel by its deviating dielectricity between the two or more fluids. The sensing of the capacitance or the sensing of the change of the capacitance is preferably made by a number of capacitors spread along the channel.

In another variant, the channel is used in a timepiece. The permanent or the electro magnets and/or electrodes required in MHD pumps, in order to be non-visible to a user, are optionally incorporated into design/decoration elements or hidden by design/decoration elements. In another variant, the permanent or the electro magnets and/or electrodes are visible to the user. In another variant, the magnets and the electrodes may be transparent.

In another variant, the capacitors used to sense the dielectricity or the change of the dielectricity is accomplished with sputtering, preferable as ITO (Indium-tin oxide) or FTO (Fluorine-doped tin oxide).

In another variant, the channel is formed as a micro capillary.

In another variant, the channel is formed by two or more glass wafers, preferably connected to each other by a suitable bonding process.

In another variant, the channel is formed by two or more polymer wafers, preferably connected to each other by a suitable bonding process.

In another variant, a membrane is embedded between wafers.

In another variant, the channel system has one or more open access holes to allow an initial filling of the system with fluid(s), implicating an automated filling of the system during the production process. Through one access hole, a fluid is inserted, while another access hole provides access to ambient or controlled pressure. After initial filling, the access hole(s) are closed in a fluid and/or gas tight manner. Optional, the access hole(s) can be opened and closed again, e.g. for maintenance reasons.

In another variant, as well for a closed loop system, as for a variant with ends ending in a reservoir, is equipped with a system to compensate thermal expansion/contraction of the fluid(s). This is accomplished by a thin and therefore flexible wafer, or a separate gas chamber, or a flexible soft material part, or a membrane. The flexible soft material part can be placed in the channel or in a separate chamber, which is in fluid communication with the channel. The compensation system is non-visible to a user, and in another variant visible to the user. The non-visible system is disposed underneath the visible system.

An object of the invention is to provide system having a closed loop, with no or few moving parts, which better ensures its durability.

Another object of the invention is to enable control of the accuracy of the otherwise haptic system using a feedback control system paced by a crystal oscillator or a connected time base, thereby dealing with a wide range of variables (temperature, viscosity, fluid flow issues) while maintaining accuracy.

Another object of the invention is to eliminate the need for complex and expensive parts such as fluid bellows or a complex micro pump.

Another object of the invention is to provide a fluid display for a jewelry item such as that developed and made famous by HYT SA of Switzerland while costing a fraction of the price, thus making this way of enjoying the passing of time accessible to a larger number of users.

BRIEF DESCRIPTION OF THE DRAWINGS

FIG. 13 is a schematic top view of the invention in a further variant.

Figure 1:
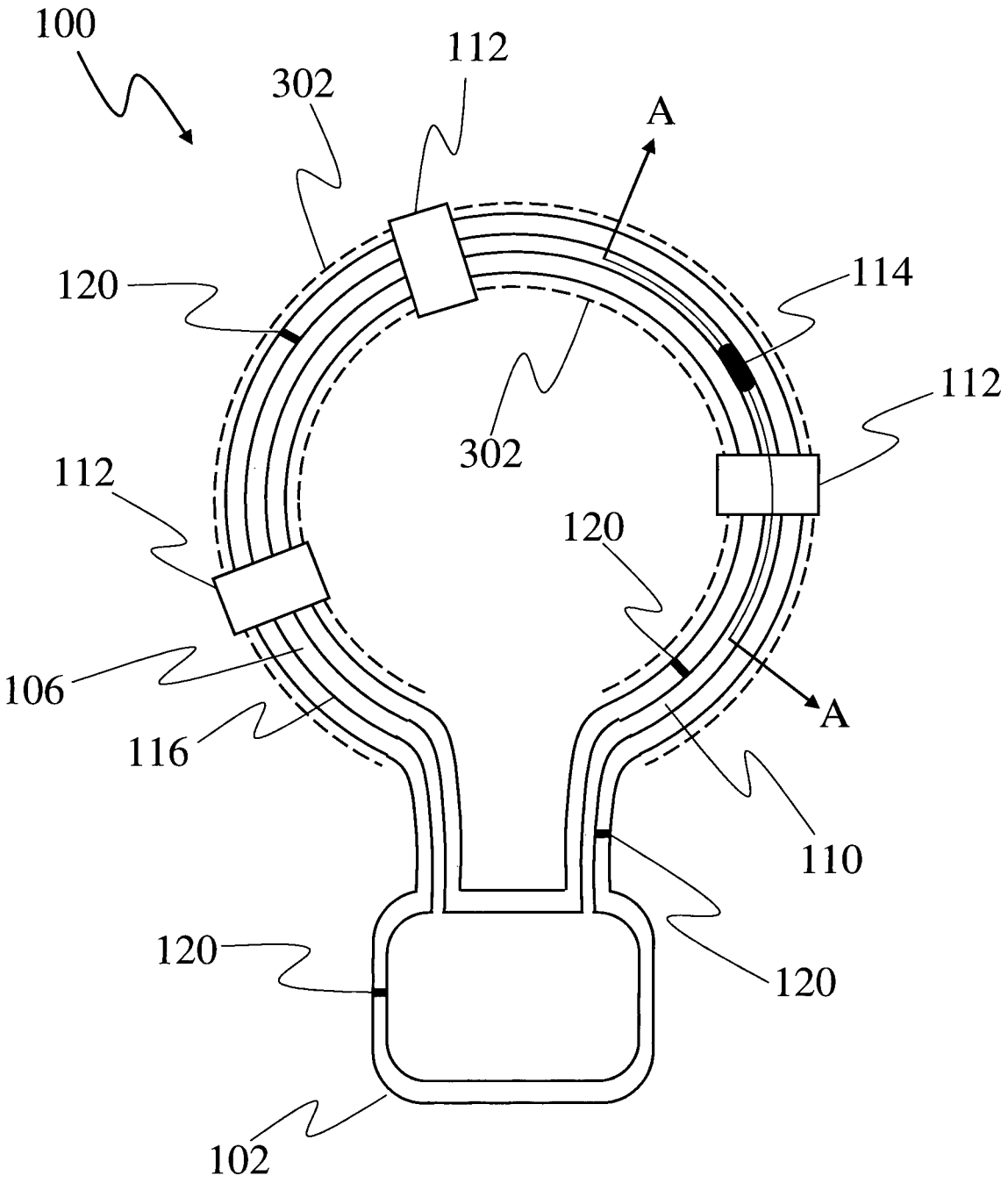
FIG. 1 is a schematic top view of the invention.

Those skilled in the art will appreciate that elements in the Figures are illustrated for simplicity and clarity and have not necessarily been drawn to scale. For example, dimensions may be exaggerated relative to other elements to help improve understanding of the invention and its embodiments. Furthermore, when the terms 'first', 'second', and the like are used herein, their use is intended for distinguishing between similar elements and not necessarily for describing a sequential or chronological order. Moreover, relative terms like 'front', 'back', 'top' and 'bottom', and the like in the Description and/or in the claims are not necessarily used for describing exclusive relative position. Those skilled in the art will therefore understand that such terms may be interchangeable with other terms, and that the embodiments described herein are capable of operating in other orientations than those explicitly illustrated or otherwise described.

DETAILED DESCRIPTION OF THE PREFERRED EMBODIMENT

The following description is not intended to limit the scope of the invention in any way as it is exemplary in nature, serving to describe the best mode of the invention known to the inventors as of the filing date hereof. Consequently, changes may be made in the arrangement and/or function of any of the elements described in the exemplary embodiments disclosed herein without departing from the spirit and scope of the invention.

Referring to the figures, an indication device 100, 200, 300, 600, 1200, 1800 of the invention includes an elongated fluid chamber 116, 202, 402, 504, 702, 1202, 1240, 1242, 1244, 1306, 1402, 1404 containing at least two immiscible fluids 106, 110, 114, 514, 710, 920, 1206, 1214, 1250, 1252, 1316, 1320, 1412, 1706 at least one of which has a characteristic physical property different from the other fluid, namely, a liquid driven by an at least one pump 112, 400, 1246, 1248, 1506 for such liquid and an immiscible fluid having a different physical characteristic from the liquid, wherein at least one feature of the liquid contained in the chamber is used as an indicator 408, 1290, 1410, which feature the at least one pump drives along the chamber either directly or indirectly, via another fluid in the chamber, along adjacent indices 1256, 1406 of an indicator 1802, 1804 visible to an observer, the indication device further including a feature location sensor 302, 406, 1600, 1700, 1710, 1712, 1714, 1720, 1722 and a feedback controller 1500 which cooperate so as to activate the pump to move the feature to a desired location in the chamber in order to e.g. indicate a quantity to the observer.

FIG. 1 is a top view of a system 100 including a capillary channel 116, at its both ends having a reservoir 102 attached. It is appreciated that the capillary channel 116 can take on a variety of geometric cross-sectional two dimensional or three dimensional cross-sectional and overall shapes or configurations, e.g. a cylindrical tube, a square, a rectangle, a circle, an oval, an oval shape, a triangular shape, a pentagonal shape, a hexagonal shape, an octagonal shape, a cubic shape, a spherical shape, an egg shape, a cone shape, a dome shape, a rectangular prism shape, and a pyramidal shape, by way of further example. In this variant the capillary channel 116 is filled with a first essentially electrically conductive, optionally colored liquid 106, implicating for example a Sodium chloride solution and a second electrically conductive or electrically non-conductive, optionally colored fluid 114, implicating for example a silicone oil or a liquid sapphire (as used herein, any liquid may having the same refractivity as the substrate), in a variant accomplished using a gas bubble. Of course, the system can contain more or less fluids and another combination of different fluids. Further, this variant is equipped with one or more magnetohydrodynamic pumps (MHD pumps) 112. The channel 116 has optionally one or more open access holes 120 to allow an initial filling of the system with fluid(s), implicating an automated filling of the system during the production process. The system is further equipped with capacitors 302. The system does compensate thermal expansions and compressions of a fluid 106, 114 located in the channel 106, 116, as proposed in FIGS. 1 and 7 to 11, for example.

Figure 2:
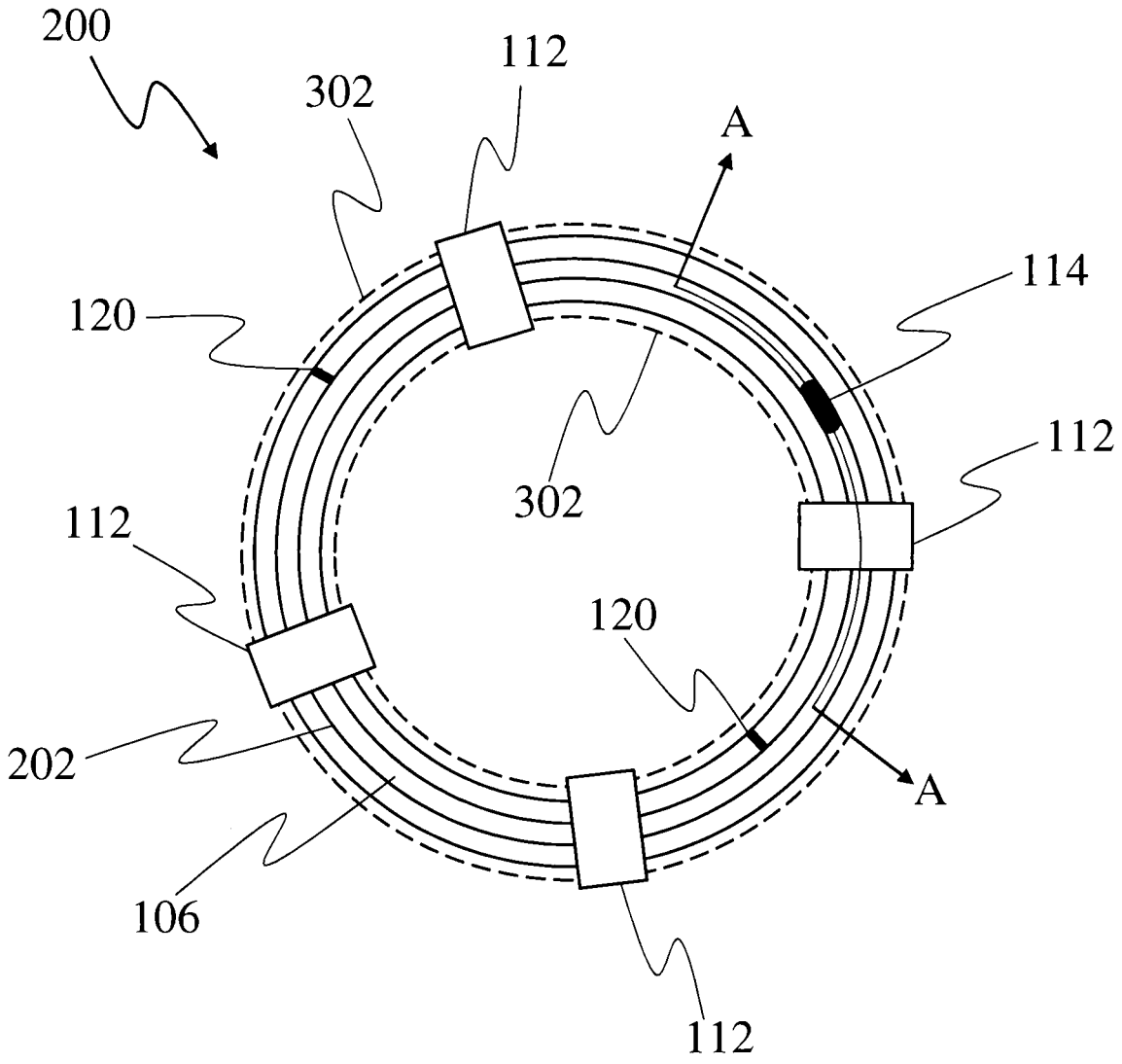
FIG. 2 is a schematic top view of the invention in another variant.

FIG. 2 is a top view of a system 200 including a capillary channel 202 formed as a closed loop. It is appreciated that the capillary channel 202 can take on a variety of geometric cross-sectional two dimensional or three dimensional cross-sectional and overall shapes or configurations as mentioned above. In this variant the capillary channel 202 is filled with a first essentially electrically conductive, optionally colored liquid 106, implicating for example a Sodium chloride solution and a second electrically conductive or electrically non-conductive, optionally colored fluid 114, implicating for example a silicone oil or liquid sapphire, in a variant accomplished using a gas bubble. Of course, the system can contain more or less fluids and another combination of different fluids. Further, this variant is equipped with one or more magnetohydrodynamic pumps (MHD pumps) 112. The channel 202 has optionally one or more open access holes 120 to allow an initial filling of the system with fluid(s), implicating an automated filling of the system during the production process. The system is further equipped with capacitors 302. The system does compensate thermal expansions and compressions of a liquid 106 located in the channel 202, as proposed in FIGS. 7 to 11.

Figure 3:
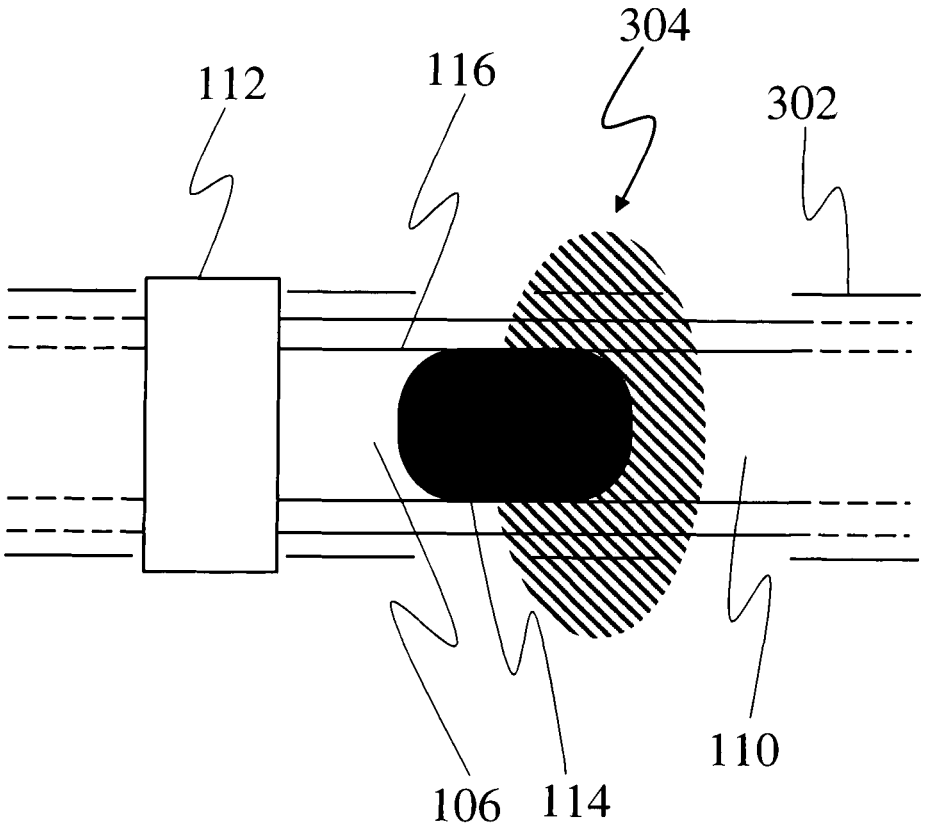
FIG. 3 is a detail view of an indicator fluid arrangement of the invention.

FIG. 3 is a sectional view A-A of FIG. 1 including a capillary channel 116. In this variant the capillary channel 116 is filled with a first essentially electrically conductive, optionally colored liquid 106, implicating for example a Sodium chloride solution and a second electrically conductive or electrically non-conductive, optionally colored fluid 114, implicating for example a silicone oil or liquid sapphire, and in a variant accomplished using a gas bubble. Of course, the system can contain more or less fluids and another combination of different fluids. Further, this variant is equipped with one or more magnetohydrodynamic pumps (MHD pumps) 112 to drive an electrically conductive, optionally colored liquid 106, which pushes or pulls an electrically conductive or electrically non-conductive fluid 114, implicating for example a silicone oil or liquid sapphire, in a variant accomplished using a gas bubble, surrounded by an optionally colored, transparent conductive liquid 110. The system is further equipped with capacitors 302 used to sense the dielectricity or the change of the dielectricity essentially at areas 304 near the capacitor or the pair of capacitor or the triple of capacitors. The capacitors are made by sputtering, preferable as ITO (Indium-tin oxide) or FTO (Fluorine-doped tin oxide). Several capacitors are placed along the channel 116. The dielectricity and/or the change of dielectricity can be sensed by dedicating one, a pair or a triple of capacitors to an area 304.

Figure 4A:
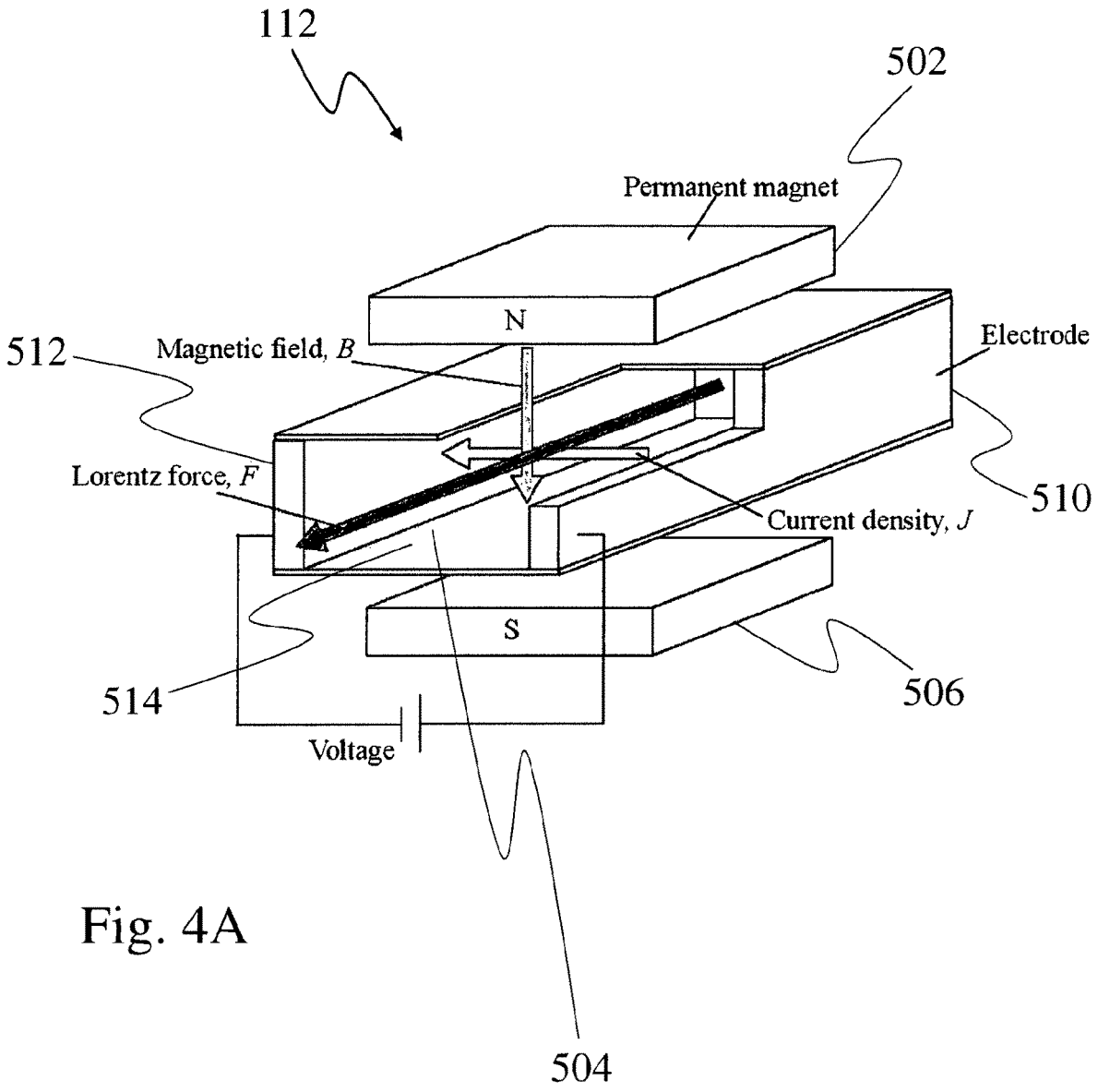
FIG. 4A is a schematic perspective view of an MI-ID pump used in the invention.

FIG. 4A is a perspective view of a magnetohydrodynamic pumps (MHD pumps) 112. The MHD pump 112 includes a permanent magnet with its polarization North 502 directed towards a channel 504, a permanent magnet with its polarization South 506 directed towards a channel 504 and essentially opposite to permanent magnet with its polarization North 502. The channel contains liquids 514, implicating for example a silicone oil, liquid sapphire or a Sodium chloride solution, in a variant accomplished using a gas bubble. The system is further equipped with a pair of electrodes 510, 512, reframing the channel 504 and essentially 90° to the permanent magnets 502, 506. To the electrodes 510, 512 a direct current (DC), positive or negative polarized, can be applied. The swap of polarization will reverse the flow of the liquids 514. The permanent magnets 502, 506 may either be in contact with the liquids 514 or not be in contact with the liquids 514 and/or gas. The electrodes 510, 512 are in contact with the liquids 514 and/or gas.

Considering the circular capillary sub-systems 100 or 200, and its various dimensions, typically a time of 60 seconds, 60 minutes or 12 hours is used to completely fill the circular capillary sub-system 100 or 200. An exemplary specification for a robust, efficient, fit for purpose MHD pump 112 is as follows:

1. Capillary sub-system 100 or 200 cross-sectional area: A=0.5 $mm^2$
2. MHD flow mean velocity: $V_{MHD}$=1.895 mm/s
3. MHD flow rate: $Q_{MHD}$=57.165 μL/min 1 MHD Micro Pump—DC MHD Micro Pump Dimensioning (1/4)

Main Formula (Channel Section: Rectangular)

$$Q = \frac{J \cdot B \cdot l}{R_{hy}}$$

$$v = \frac{J \cdot B \cdot l}{A \cdot R_{hy}}$$

$$R_{hy} = \frac{8\mu L(w+h)^2}{w^3 h^3}$$

$$Q_d = \frac{UI}{L} = EI$$

Where:

[ ]Q: MHD flow rate [μL/min]
[ ]J: Current density [A/m]
[ ]B: Magnetic field [T]
[ ]I: MHD motor length [mm]
[ ]$R_{hy}$: Hydraulic pressure [N*s/$m^5$]
[ ]v: flow velocity [mm/s]
[ ]A: Fluidic channel cross-section area [$mm^2$]
[ ]μ: Liquid viscosity [Pa*s]
[ ]L: Channel total length [mm]
[ ]w: Channel width [mm]
[ ]h: Channel depth [mm]
[ ]Qd: Power dissipation [W/m]
[ ]U: Voltage on the electrodes [V]
[ ]I: Current going through the electrodes [A]

Reference: *Design, Microfabrication, and Characterization of MHD Pumps and their Applications in NMR Environments*, Thesis by Alexandra Homsy, 2006

Of course, the stronger the MHD pump 112 is, the more fluid is moved into cavity 116 or 202 at a faster rate. Slower rates of filling are accomplished by weaker MHD pumps 112 depending on their overall specifications and pumping strength.

Now looking at other MHD pump variants in the comparison provided below, and summarized in Table 1 below, it is appreciated that the example highlighted in red approximates the required specifications. Other MHD pumps can be used, depending upon the requirements of fluid movement, either continuous or intermittent, or those that require faster or slower fluid movement in the cavity 116 or 202. It is appreciated that an MHD pump 112, and circular capillary sub-system 100 or 200 featuring cavity 116 or 202 is provided in another variant. Other variants of dimensions (area, volume, geometric shape) of components of sub-system 100 or 200 are also provided in combination with other MHD pumps that have other engineered properties and modes of operation, some being fit for purpose and some not, but preferably, the specifications of MHD pump 112 underlined in Table 1 are preferable for optimal fluid movement in cavity 116 or 202.

manifold into more than one capillary sub-systems, in series or in parallel, alone or in combination with other MHD pumps providing for multiple indicator functionality within a single device, e.g. a wristwatch.

Figure 4B:
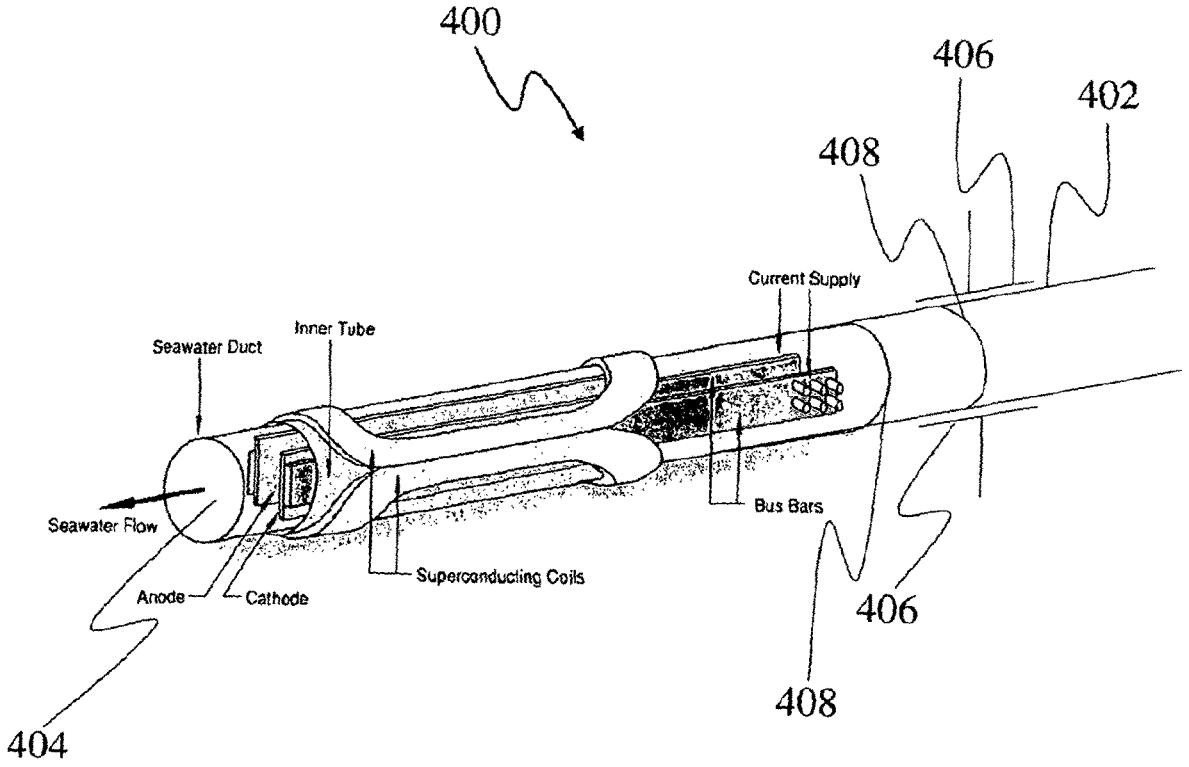
FIG. 4B is a schematic perspective view of an alternate MID pump configuration used where a continuous capillary tube contains the fluids used in the invention.

Referring now to FIG. 4B, an alternate MHD pump 400 configuration is particularly advantageous when used where a continuous capillary tube 402 contains the fluids used in the invention. The MHD pump 400 is DC-current powered. A plurality of ITO/FTO 406 sensor are preferably used to sense the location of the meniscus 408 without having to be in direct contact therewith. Using the ITO/FTO sensor 406, setting the time is simplified, as all that is required is that once the setting mode is activated, to touch the location where the meniscus 408 should be located on the hour and/or minute display. The change in capacitance is sensed and the feedback loop controller 1500 is operated to move the meniscus 408 into the proper position.

TABLE 8.1

Performance comparison of previously published MHD pumps with our MHD pump presented in Ch 4 and 6. All values for voltage (U), current (I), channel cross-sectional area (A), total length of electrodes along the pumping channel (l). MHD flow mean velocity in the pumping channel ($v_{MHD}$) and MHD flow rate ($Q_{MHD}$) were experimental data, and were taken from references [1-6]. Most of the values for the electrode cross-sectional area ($A_J$) and current density (J) across the pumping channel had to be calculated. The body force ($\Delta P_{MHD}$) generated by the pumps was calculated thanks to relation 2.14. *Both values were taken from experimental measurements. If calculated with relations 2.16 and 2.15, the predicted velocity and flow rate would be 0.16 mm · $s^{-1}$ and 4 μL · $min^{-1}$ respectively.

| | U (V) | I (mA) | A ($mm^2$) | $A_J$ ($mm^2$) | l (mm) | J (A · $m^{-2}$) | B (T) | $\Delta P_{MHD}$ (Pa) | $v_{MHD}$ (mm · $s^{-1}$) | $Q_{MHD}$ (μL · $min^{-1}$) |
|---|---|---|---|---|---|---|---|---|---|---|
| Jang et al. [1] | 30 DC | 1.8 | 0.4 | 30 | 30 | 60 | 0.44 | 1 | 2.6* | 63* |
| Leventis et al. [2] | >1.3 DC | 35 | 18 | 225 | 75 | 155 | 1.35 | 16 | 0.4 | $450 \cdot 10^3$ |
| Bau et al. [3] | 4 DC | 15 | 1.9 | 292 | 172 | 51 | 0.4 | 3.5 | 0.4 | 45 |
| Lemoff et al. [4] | 6.6 AC | 140 | 0.2 | 1.5 | 4 | 92105 | 0.013 | 5 | 1.5 | 18 |
| West et al. [5] | 5 AC | 90 | 0.2 | 5 | 28 | 17684 | 0.011 | 5.5 | 0.24 | 3 |
| Eijkel et al. [6] | 4 AC | 40 | $6 \cdot 10^{-3}$ | 2 | 63 | 21100 | 0.1 | 133 | 0.04 | $14 \cdot 10^{-3}$ |
| Chapter 4 | 16 DC | 4.8 | $8.8 \cdot 10^{-3}$ | 1.2 | 16 | 4000 | 0.42 | 27 | 0.5 | 0.3 |
| Chapter 6 | 19 DC | 2 | $8.8 \cdot 10^{-3}$ | 1.2 | 16 | 1600 | 7.05 | 180 | 2.8 | 1.5 |

The following list of references with respect to MHD pumps are incorporated into this patent application by reference in their entirety, showing the variety of MHD pumps in the market:

1. Design, Microfabrication, and Characterization of MHD Pumps and their Applications in NMR Environments, Thesis by Alexandra Homsy, 2006.
2. Bislug Flow in Circular and Noncircular Channels and the Role of Interface Stretching on Energy Dissipation, Thesis by Joseph E. Hernandez, August 2008.
3. Modeling RedOx-based magnetohydrodynamics in three-dimensional microfluidic channels, Hussameddine Kabbani et al., 2007.

The following references with respect to alternative pumps (which substitute herein for MHD pumps where the characteristic of conductivity is no longer required for operation) are to be incorporated into this patent application by reference in their entirety:

1. Micropumps—summarizing the first two decades, Peter Woias, 2001.
2. Disposable Patch Pump for Accurate Delivery, Laurent-Dominique Piveteau, 2013, p. 16 and ff.

Figure 5:
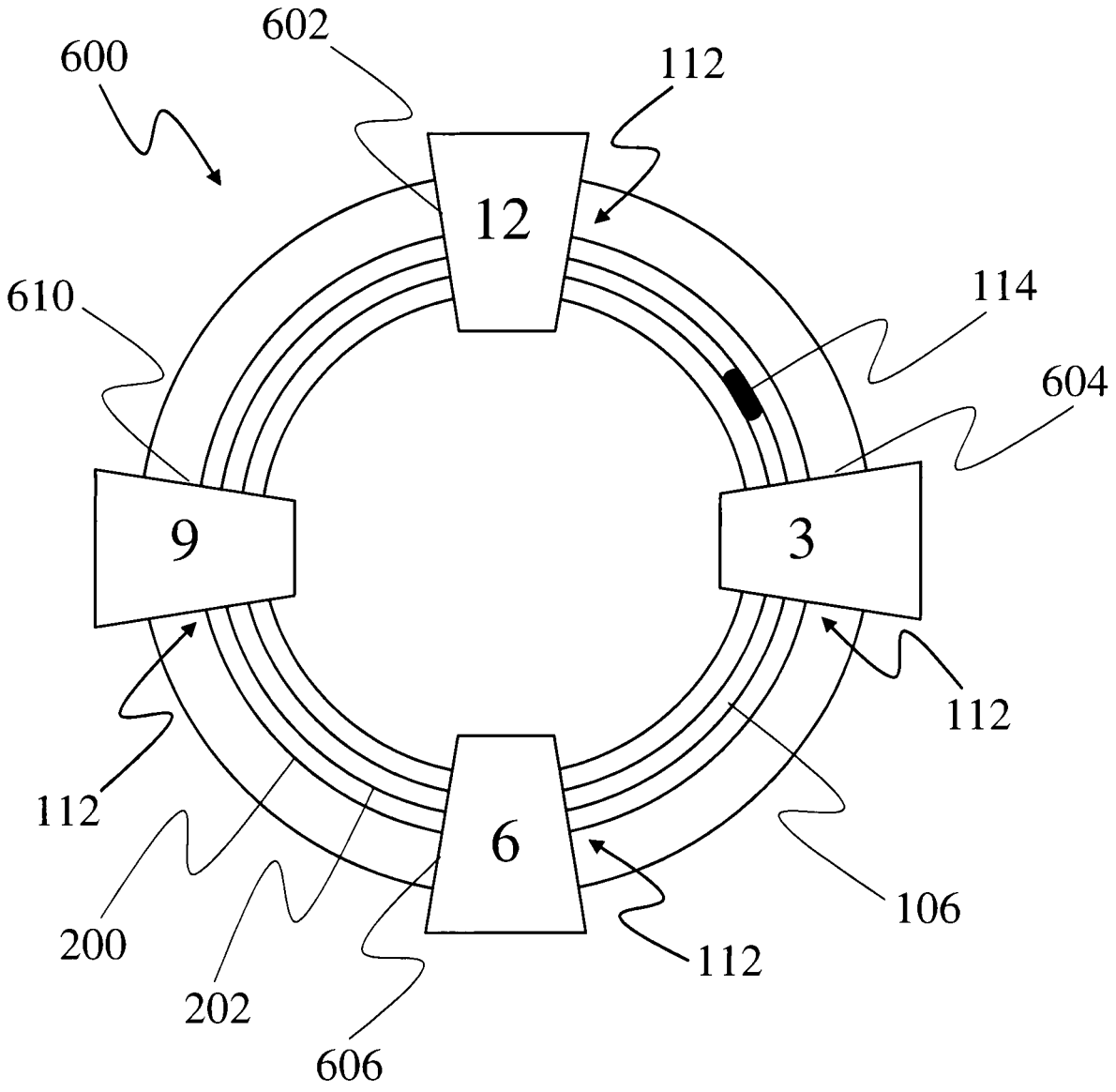
FIG. 5 is a schematic top view of the invention in another variant.

In yet a further aspect, the invention also provides for a grouping of sub-systems that include a circular (or other geometric configuration) capillary sub-system(s) with one or more MHD pumps 112. The groups include one or more MHD pumps 112 and tube/cavity combinations or groups of inter-related sub-systems. The one or more than one MHD pump 112 manages displacement of one or more fluids within individual circular capillary sub-systems or by way of FIG. 5 is a top view of a timepiece 600 equipped with system 200. The system 200 includes a capillary channel 202 formed as a closed loop. In this variant the capillary channel 202 is filled with a first essentially electrically conductive liquid 106, implicating for example a Sodium chloride solution and a second electrically conductive or electrically non-conductive, optionally colored fluid 114, implicating for example silicone oil or liquid sapphire, in a variant accomplished using a gas bubble. Of course, the system can contain more or less fluids and another combination of different fluids. Further, this variant is equipped with four magnetohydrodynamic pumps (MHD pumps) 112. The magnetohydrodynamic pumps (MHD pumps) are incorporated into design/decoration elements or hidden by design/decoration elements 602, 604, 606, 610, in order to be non-visible to a user.

Figure 6:
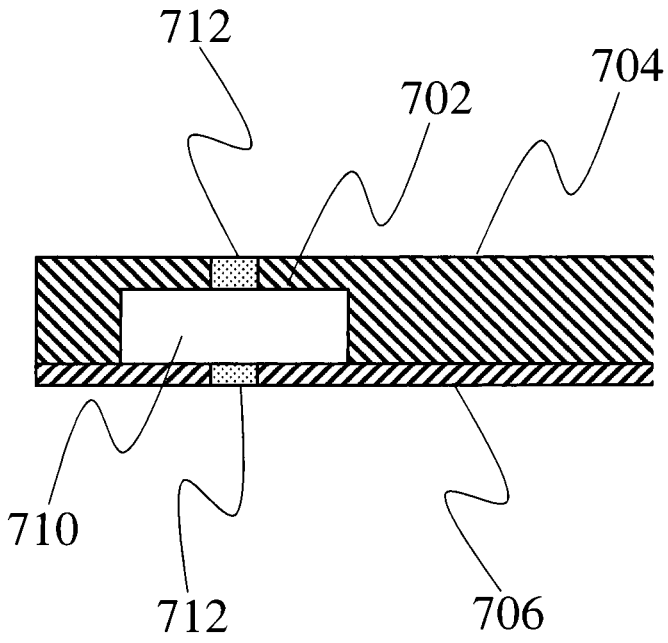
FIG. 6 is a cross sectional detail view of the fluid reservoir of the invention.

FIG. 6 is a cross sectional view of variant of system 100 or system 200. The channel 702 is formed by two wafers 704, 706, implicating wafers made out of glass and/or polymer. The wafers 704, 706 are fixed to each other preferably by a suitable bonding process. The channel 702 contains one or more liquids and/or gas 710, implicating for example a silicone oil, liquid sapphire or a Sodium chloride solution. Wafer 706 is particularly thin in the region of the channel 702 and is therefore enough flexible in that region to compensate thermal expansions and compressions of a fluid 710 located in the channel 702. The channel 702 has optionally one or more open access holes 712 to allow an initial filling of the system with fluid(s) 710, implicating an automated filling of the system during the production process.

Figure 7:
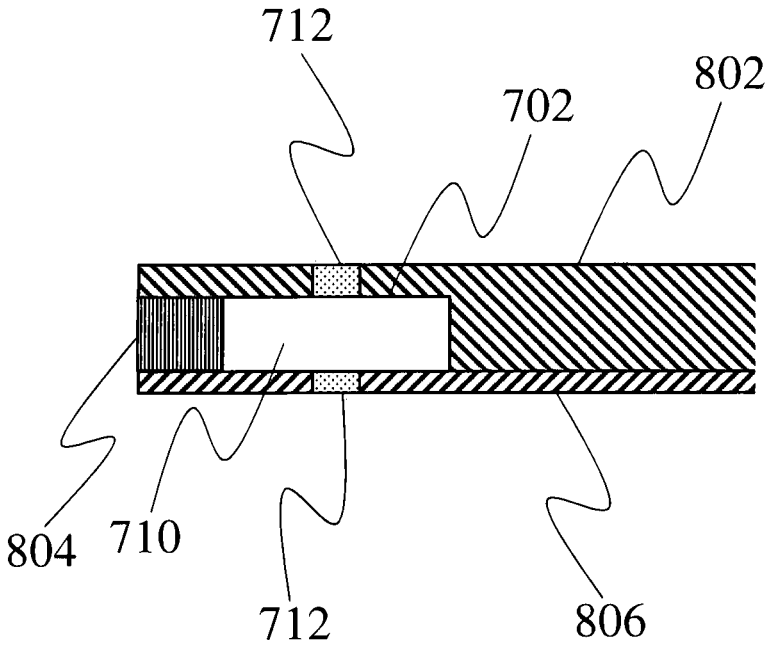
FIG. 7 is across sectional detail view of a variant of the fluid reservoir of the invention.

FIG. 7 is a cross sectional view of variant of system 100 or system 200. The channel 702 is formed by three or more wafers 802, 804, 806, implicating wafers made out of glass and/or polymer. The wafers 802, 804, 806 are fixed to each other preferably by a suitable bonding process. The channel 702 contains one or more liquids and/or gas 710, implicating for example a silicone oil, liquid sapphire or a Sodium chloride solution. Wafer 806 is particularly thin in the region of the channel 702 and is therefore enough flexible in that region to compensate thermal expansions and compressions of a fluid 710 located in the channel 702. The channel 702 has optionally one or more open access holes 712 to allow an initial filling of the system with fluid(s) 710, implicating an automated filling of the system during the production process.

Figure 8:
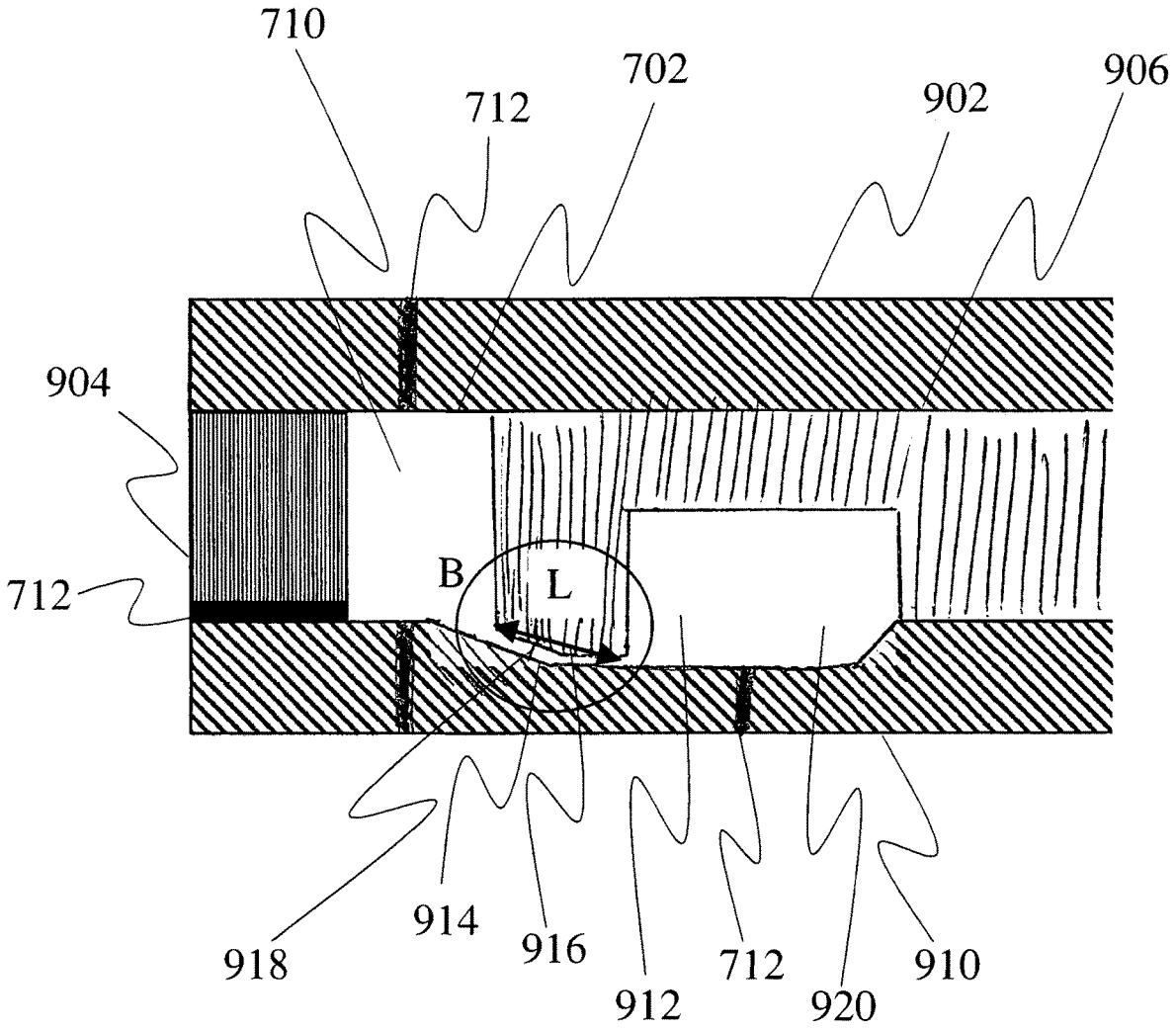
FIG. 8 is a cross sectional detail view of another variant of the liquid reservoir of the invention.

FIG. 8 is a cross sectional view of variant of system 100 or system 200. The channel 702 is formed by four wafers 902, 904, 906, 910, implicating wafers made out of glass and/or polymer. The system can also be formed by less or more wafers. The wafers 902, 904, 906, 910 are fixed to each other preferably by a suitable bonding process. The channel 702 contains one or more fluids 710, implicating for example a silicone oil, liquid sapphire or a Sodium chloride solution. Wafers 906, 910 form a gas chamber 912 containing essentially gas 920. Gas chamber 912 and channel 702 are connected to each other through a thin transit passage 914. The thin transit passage has a certain length 916, typically 0.5-2 mm. The intersection 918 between gas 920 and fluid 710 is essentially within the length 916. The compressibility of gas 920 in combination with this system allows to compensate thermal expansions and compressions of a fluid 710 located in the channel 702. The channel 702 and/or the gas chamber 912 has optionally one or more open access holes 712 to allow an initial filling of the system with fluid(s) 710 and/or gas 920, implicating an automated filling of the system during the production process.

Figure 9:
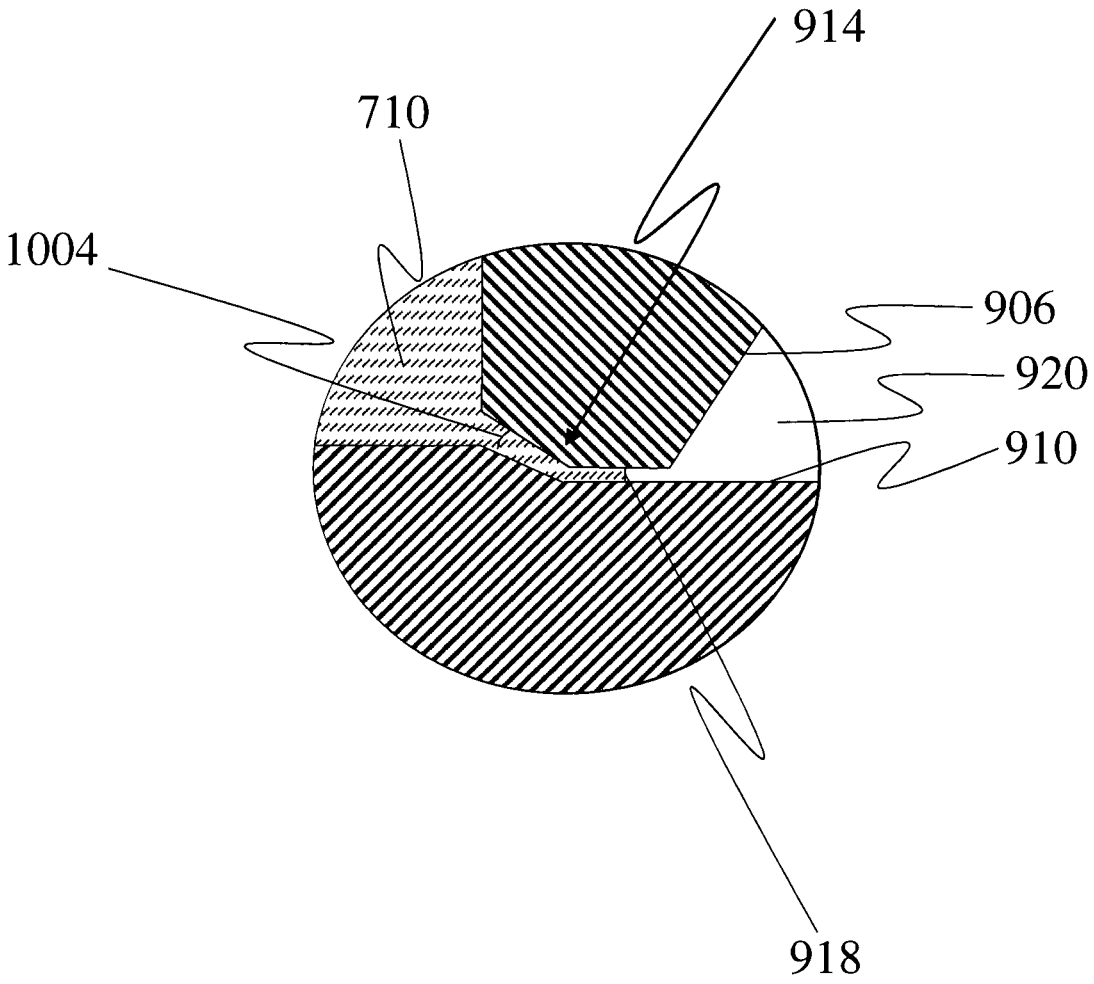
FIG. 9 is a cross sectional view of a detail view of an element of FIG. 8.

FIG. 9 is the detail view B of FIG. 8. The thin transit passage 914 is shown in detail. To optimize the trapping of a fluids 710, the angle 1004 between wafers 906, 910 at the entrance of the thin transit passage can be positive, zero or negative. The forming of the thin transit passage 914 can further be freely chosen in order to optimize a proper separation of gas 920 and fluid 710. To prevent mixing or migration of gas 920 from gas chamber 912 to the channel 702, the dimensions and shape of the thin transit passage 914 has to be adapted according to the viscosities of the fluids 710.

Figure 10:
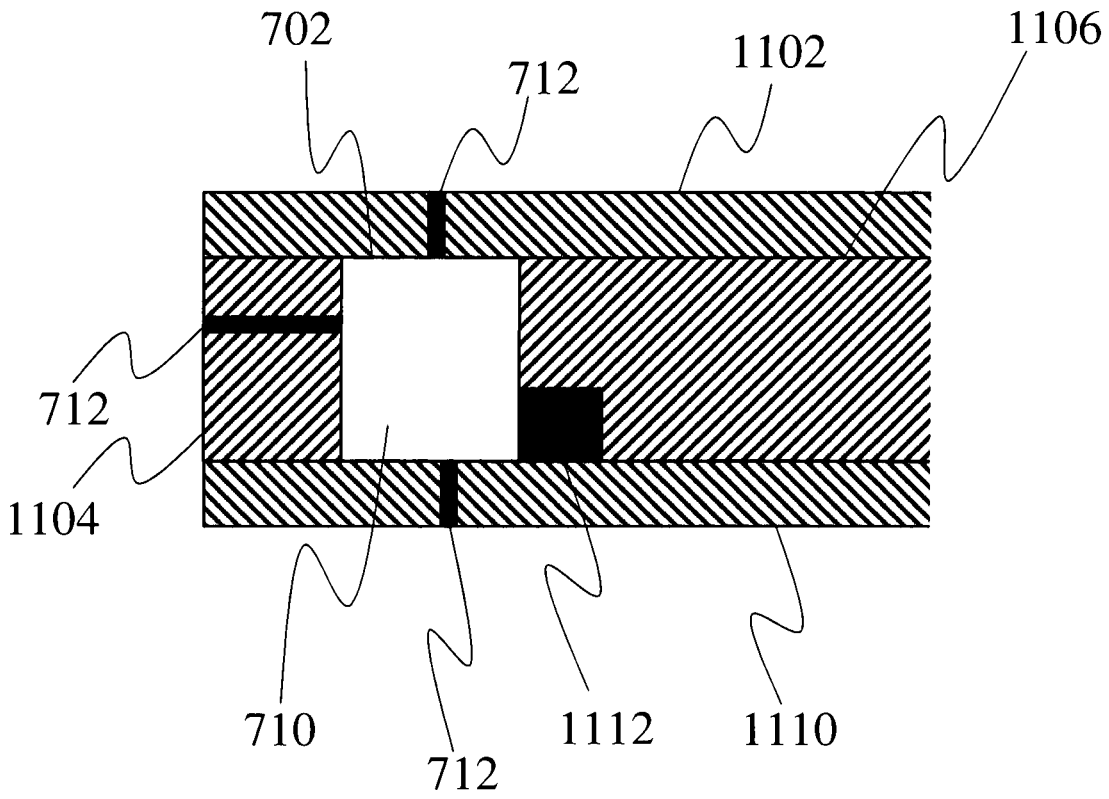
FIG. 10 is a cross sectional detail view of still another variant of the fluid reservoir of the invention.

FIG. 10 is a cross sectional view of variant of system 100 or system 200. The channel 702 is formed by four wafers 1102, 1104, 1106, 1110, implicating wafers made out of glass and/or polymer. The system can also be formed by less or more wafers. The wafers 1102, 1104, 1106, and 1110 are fixed to each other preferably by a suitable bonding process. The channel 702 contains one or more fluids 710, implicating for example a silicone oil, liquid sapphire or a Sodium chloride solution, in a variant accomplished using a gas bubble. A soft material 1112 is located at a specific place to be in contact with the liquid and/or gas 710. The soft material 1112 has the property to compensate thermal expansions and compressions of a fluid 710 located in the channel 702. The channel 702 has optionally one or more open access holes 712 to allow an initial filling of the system with liquid(s) and or gas' 710, implicating an automated filling of the system during the production process.

Figure 11:
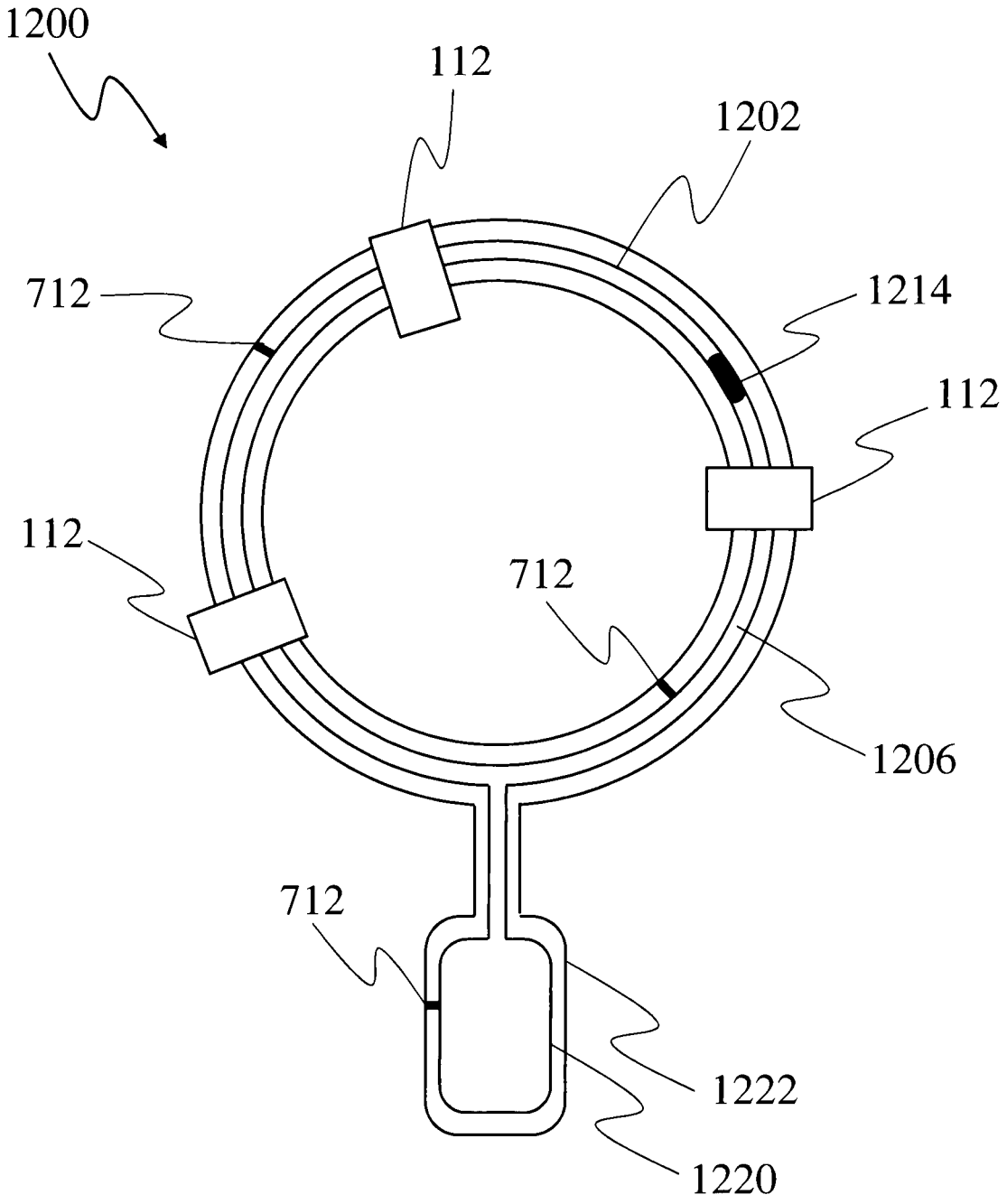
FIG. 11 is a schematic top view of the invention in another variant.

FIG. 11 is a top view of a system 1200 including a capillary channel 1202 formed as a closed loop. It is appreciated that the capillary channel 1202 can take on a variety of geometric cross-sectional two dimensional or three dimensional cross-sectional and overall shapes or configurations. In this variant the capillary channel 1202 is filled with a first essentially electrically conductive, optionally colored liquid 1206, implicating for example a Sodium chloride solution and a second electrically conductive or electrically non-conductive, optionally colored fluid 1214, implicating for example a silicone oil or liquid sapphire, in a variant accomplished using a gas bubble. Of course, the system can contain more or less fluids and another combination of different fluids. Further, this variant is equipped with one or more magnetohydrodynamic pumps (MHD pumps) 112. A reservoir 1220 is located at a specific place in fluid communication with the channel 1202. The housing 1222 of the reservoir 1220 has the ability to compensate thermal expansions and compressions of a liquid 1206 located in the channel 1202. Such compensation, however, may also be obtained such as described in FIG. 3 of PCT/IB2015/000448, filed 7 Apr. 2015, entitled SYSTEMS AND METHODS FOR ABSORPTION/EXPANSION/CONTRACTION/MOVEMENT OF A LIQUID IN A TRANSPARENT CAVITY. The channel 1202 and/or the housing 1222 of the reservoir 1220 has optionally one or more open access holes 712 to allow an initial filling of the system with fluid(s) or gas 1206, 1214, implicating an automated filling of the system during the production process.

FIGS. 12A to 12E are a variant of a system as e.g. described in FIG. 2, FIG. 5 or FIG. 11, including a closed loop 1302. The channel 1306 is formed by fixing two or more wafers 1310, 1312, 1314 together, implicating wafers made out of glass and/or polymer. The channel 1306 may be filled with fluid, gas, solid particles or a combination thereof. In this variant, the channel is filled with two different types of fluids 1316, 1320, implicating for example a silicone oil, liquid sapphire or a Sodium chloride solution. At least one of the filled fluids is essentially electrically conductive. An MHD pump 112 is integrated having its permanent magnets 502, 506 placed along the inner diameter and along the outer diameter between two wafers 1310, 1314. Further, wafer 1310 and wafer 1314 are electrically conductive and function as electrodes. The electrical conductivity on wafers 1310, 1314 are preferable achieved by sputtering, preferable as ITO (Indium-tin oxide) or FTO (Fluorine-doped tin oxide). The essentially electrically conductive liquid 1316 will be driven forward or backwards by a Lorenz force, created by the magnetic field 1322 generated by the permanent magnets 502, 506 in combination with the electrical field 1324 generated between the two wafers 1310, 1314 connected to a direct current (DC) voltage source. The swap of polarization will reverse the flow of the fluids 1316, 1320. Of course, this variant contains mechanism to compensate thermal expansion and/or contractions of the fluid, as described before. And of course, this variant contains capacitors to measure the dielectricity and/or the change of dielectricity as described in FIG. 3.

Figure 12A:
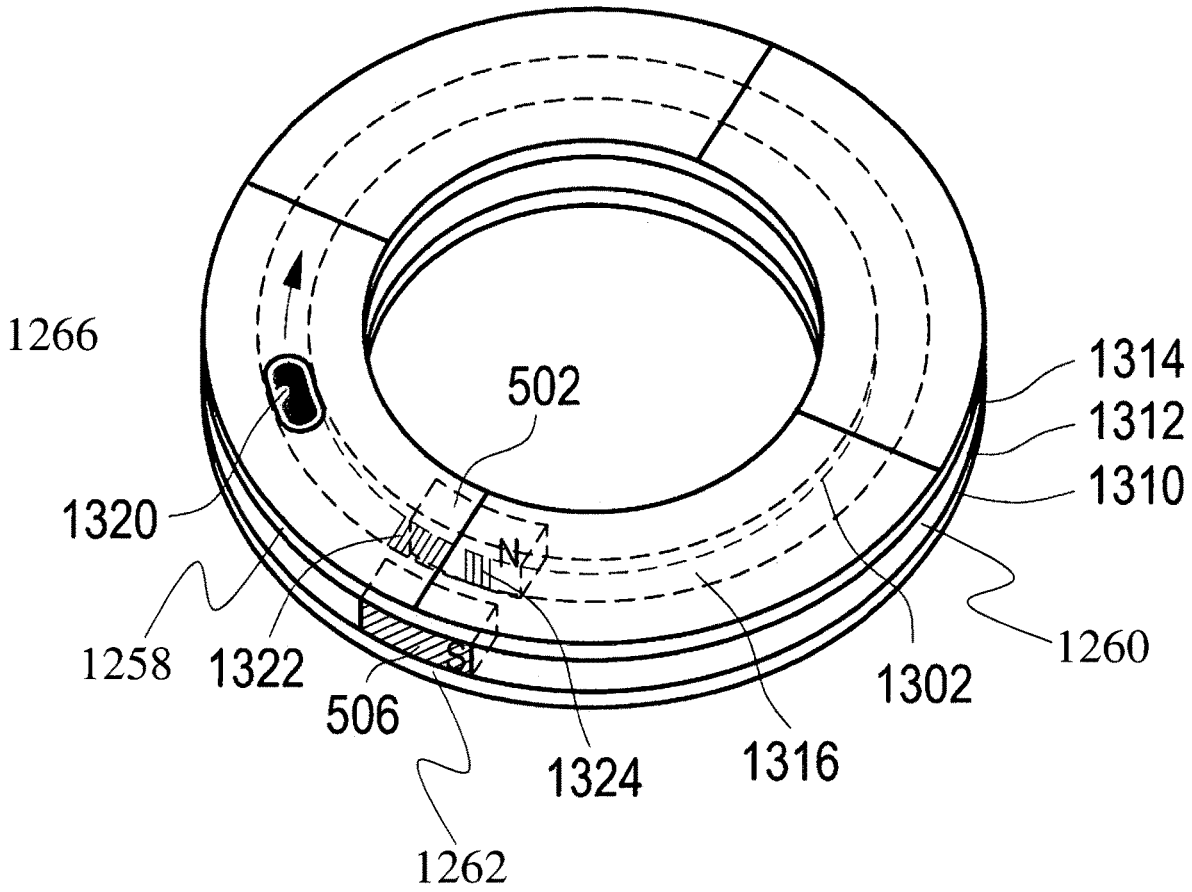
FIG. 12 is a schematic perspective view of the invention in still another variant.
FIG. 12B is a schematic top view of an optional embodiment of FIG. 12A including a continuous, endless elongated chamber.
FIG. 12C is a schematic top view of the system of the invention at time 12 AM or PM
FIG. 12D is a schematic top view of the system of the invention at time 5:59 AM or PM.
FIG. 12E is a schematic top view showing in detail the layered construction of the fluid chamber.
Figure 12B:
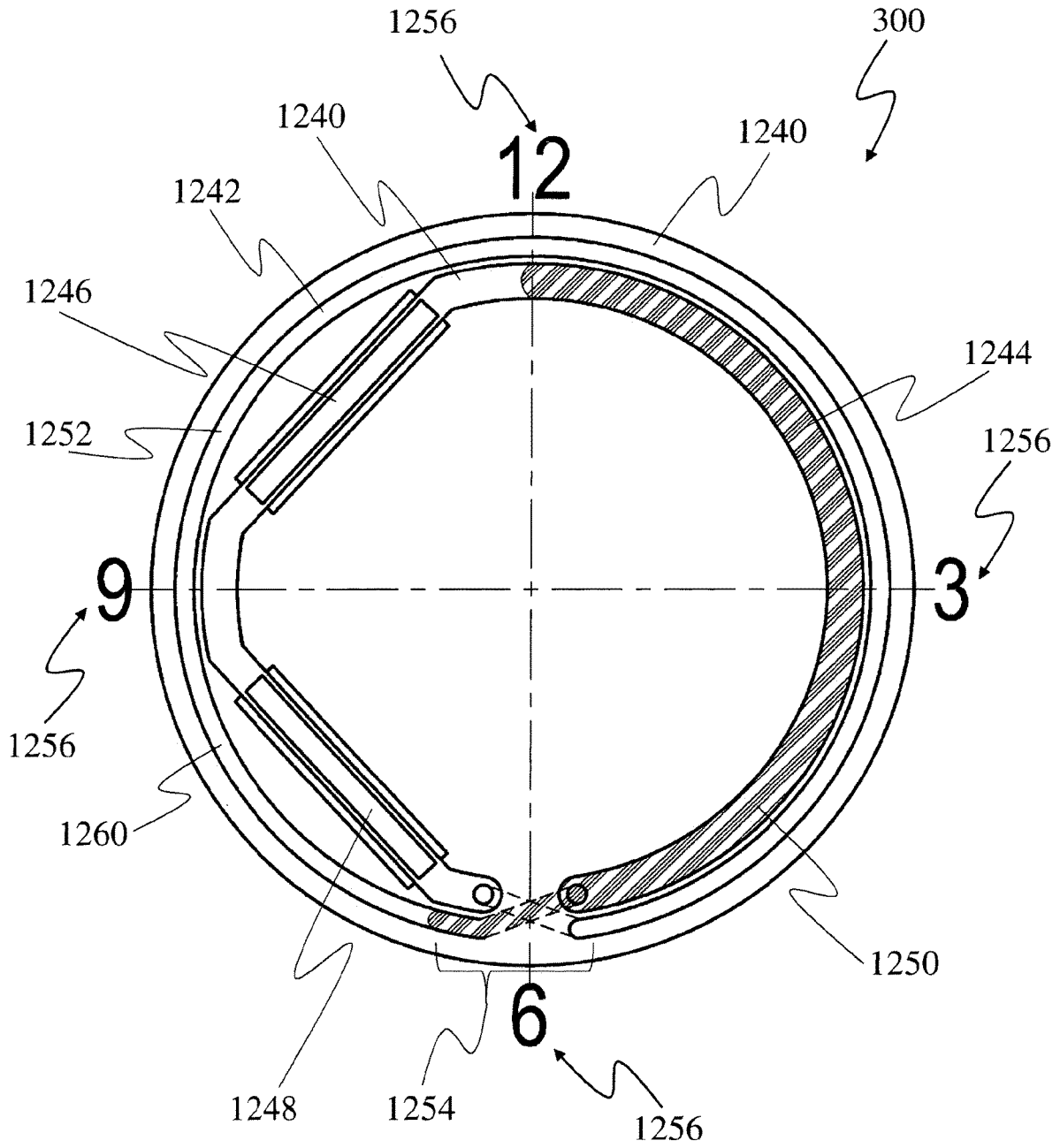

Referring in particular to FIG. 12B, an optional embodiment of FIG. 12A includes a continuous, endless elongated chamber 1240 having an upper, visible portion 1242, and a lower, hidden portion 1244 including one or two MHD pumps 1246, 1248 for driving the contained conductive liquid 1252. By driving the liquid 1252, the liquid 1252 transmits its movement to the other electrically conductive or electrically non-conductive fluid(s) 1250, for example a gas. A cross over or transitional portion 1254 of the channel directs the contents of the hidden portion of the channel 1240 to the visible portion of the channel and vice versa.

Indices 1256, in this case, numbers 12, 3, 6 and 9 are provided to facilitate reading the time. The chamber 1240 is of the form of a continuous loop looped once around itself. Here, the system 300 is shown at time 6:01 AM or PM. In the present example, the fluids include a transparent, conductive liquid 1252 and a colored or opaque non-transparent fluid 1250 which may be relatively non-conductive or conductive. Of course, it is understood that the color characteristic attributed to the fluid is exemplarily and might be arbitrary. One can see from the figure that the colored fluid 1250 fills the hidden channel about 50% of the volume of the hidden portion of the channel. Note that a designer of ordinary skill can vary the size (width and depth) of the hidden portion of the chamber as compared to that of the visible chamber to adjust the flow of fluid in the visible and hidden portions of the chamber.

Figure 12C:
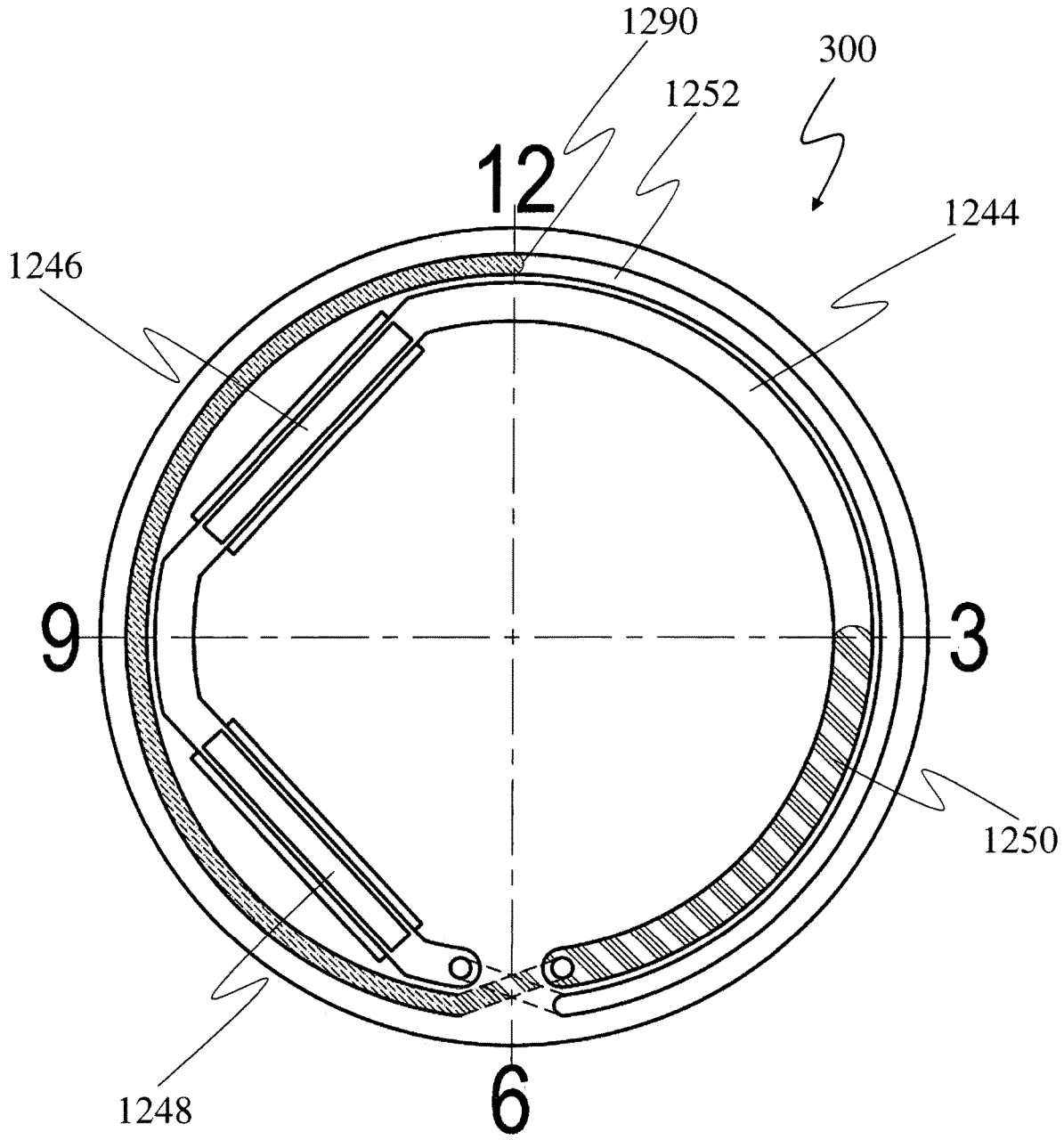

Referring in particular to FIG. 12C, here, the system 300 is shown at time 12 AM or PM. One can see from the figure that the colored fluid 1250 fills the hidden channel 1244 about 25% of its volume.

Figure 12D:
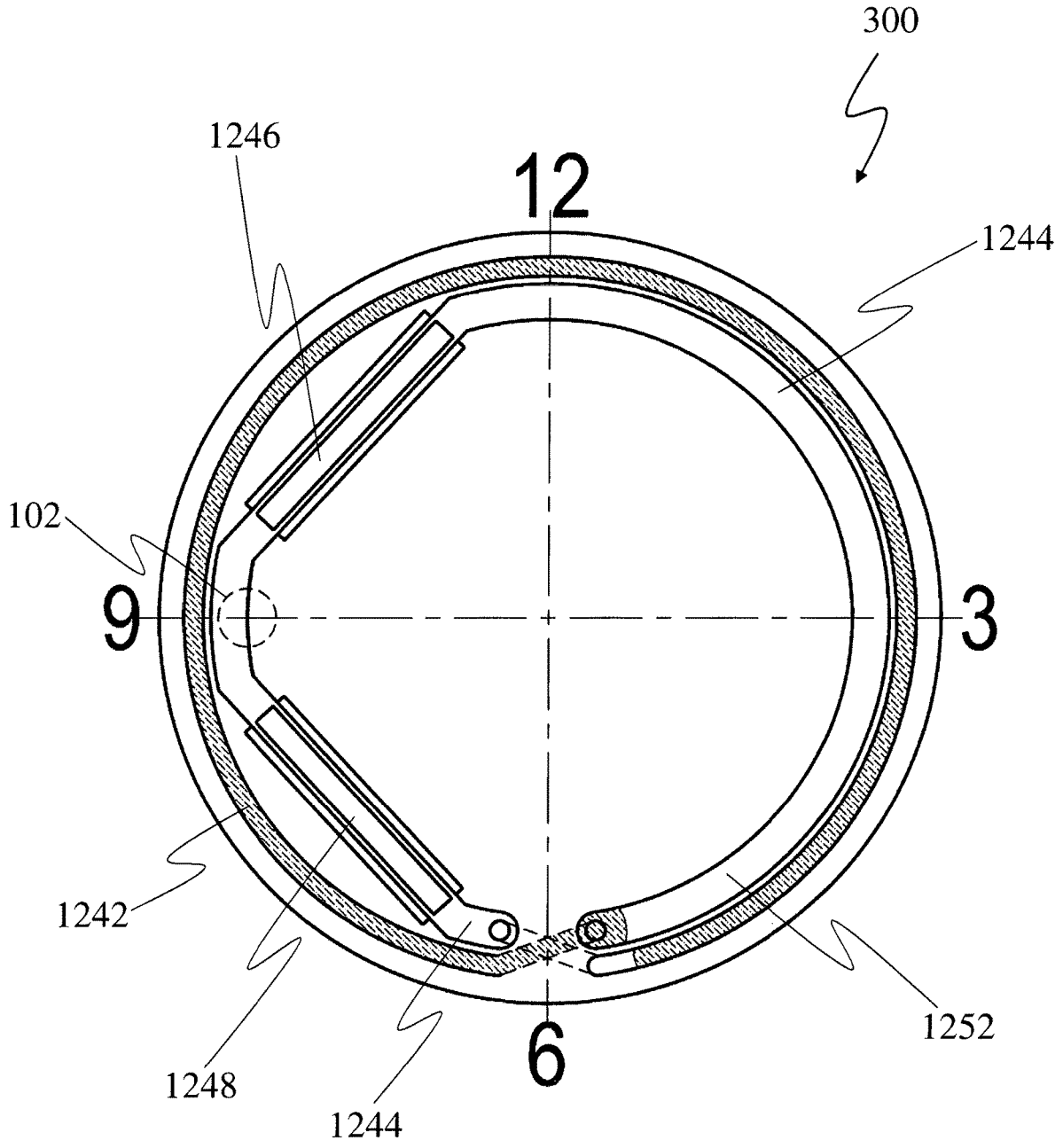

Referring in particular to FIG. 12D, here, the system 300 is shown at time 5:59 AM or PM. One can see from the figure that the transparent liquid 1252 almost completely fills the hidden channel 1244 including the portion of the hidden channel having the MHD pumps 1246, 1248. It should be apparent now that the invention is designed such that the conductive liquid 1252 is always in contact with the MHD pump(s) 1246, 1248, in order to ensure the ability of the system 300 to drive the same. The visible portion 1242 is for time indication. The portion 1242 of the hidden chamber 1244 between the MHD pumps 1246, 1248 is a suitable location for the fluid expansion or contraction device 102, 802, 904, 1112, and 1220 described in FIGS. 1 and 7-11 above.

Figures 12E, 13A, 13B, 13C, 13D:
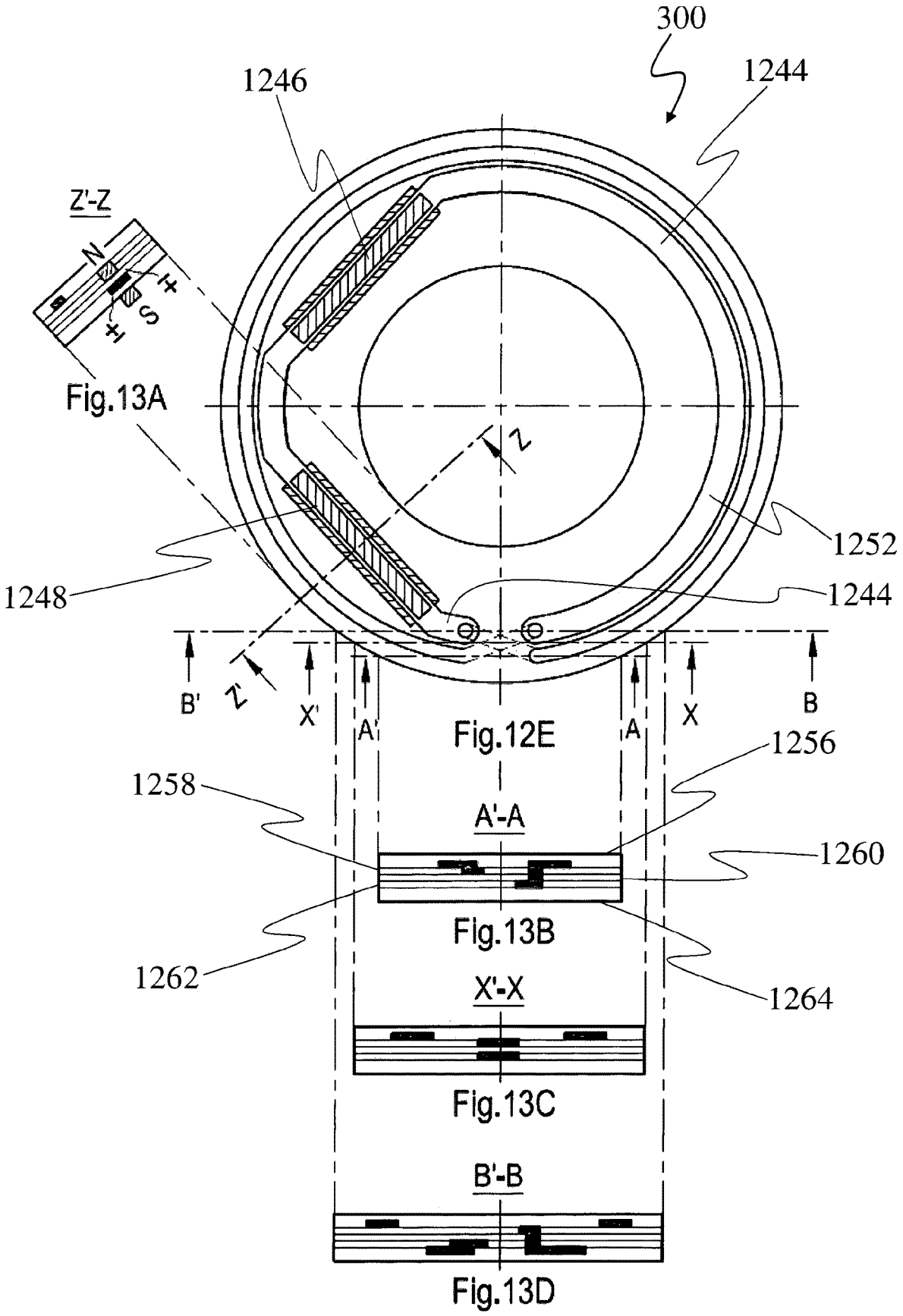
FIGS. 13A to 13D are cross sectional view taken along planes ZZ', AA', XX', and BB' of FIG. 12E.

Referring in particular to FIG. 12E, here, more detail of the layer 1266 on layers 1266, 1258, 1260, 1262, and 1264, construction of the fluid chamber 1240 is provided, wherein cross section planes ZZ', AA', XX', and BB' are located.

Referring now to FIGS. 13A to 13D, the cross sections of the planes ZZ', AA', XX', and BB' of the fluid chamber 1240 of the system 300 located in FIG. 12E are illustrated.

Figure 14:
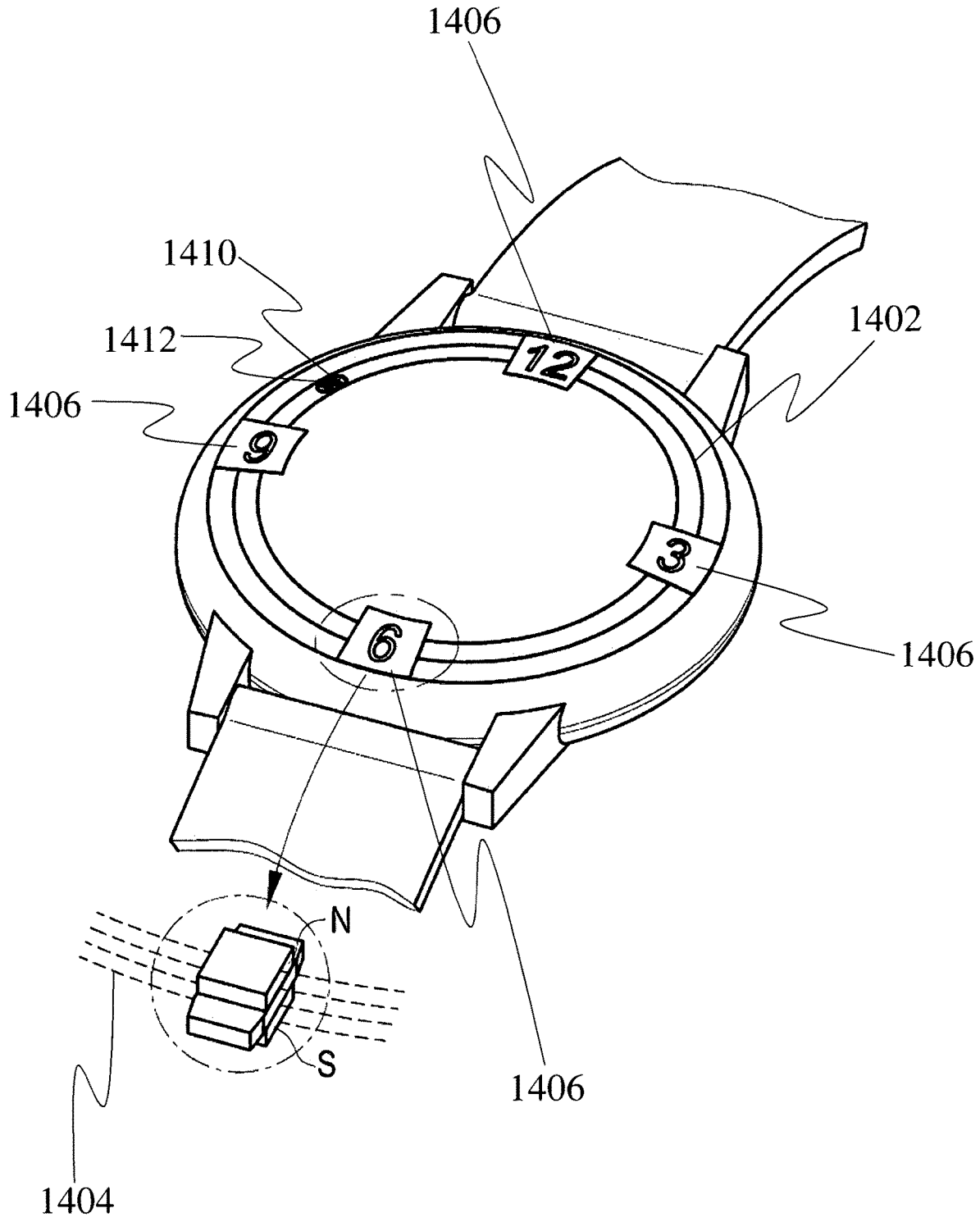
FIG. 14 is an embodiment of the invention using a capillary tube display, illustrating a MI-ID pump incorporated/hidden by design/decoration elements.

Referring now to FIG. 14, an embodiment of the invention using either a visible portion of a round capillary tube 1402 for display (which can, for example, use the MHD pump 400 of FIG. 4B) or a fluidic, channel 1404 which is square or rectangular in cross section (which can use the MHD pump 112 of FIG. 4A) is shown. The MHD pump or pumps 112, 400 are located in the design elements 1406 which indicate time indices 12, 3, 6 and 9. A transparent conductive liquid 1252 fills essentially the entire visible capillary 1402, 1404. A small drop or bubble 1410 of immiscible fluid 1412 (when not a gas, preferably opaque or colored) that is non-conductive or has a much lower conductivity, indicates time as did the meniscus 1290 in previous embodiments. At least two MHD pumps 1246, 1248 are built into these indices 1406 as shown, to ensure that at least one MHD pump 1246 or 1248 is always in contact with the conductive liquid 1252, to ensure the ability of the system 300 to drive the same. In such an embodiment, a sensor (not shown) is disposed along the longitudinal length of the capillary tube 1402, within and along the floor of the same, the sensor having sectors which sense local capacitance or differences in adjacent capacitance (as diagrammed in FIG. 17E), in order to allow for detection and control of the position of the meniscus 1290 or non-conductive fluid 1250. Alternatively, a plurality of sensors which optionally extend through holes (not shown) along the floor of the capillary tube 1402, provide the necessary sensing function, which, along with the closed feedback loop system 1500 and an element providing a pace or reference/target output, e.g. a watch movement (not shown) such as a quartz movement, ensures the accuracy of the system 300.

Figure 15:
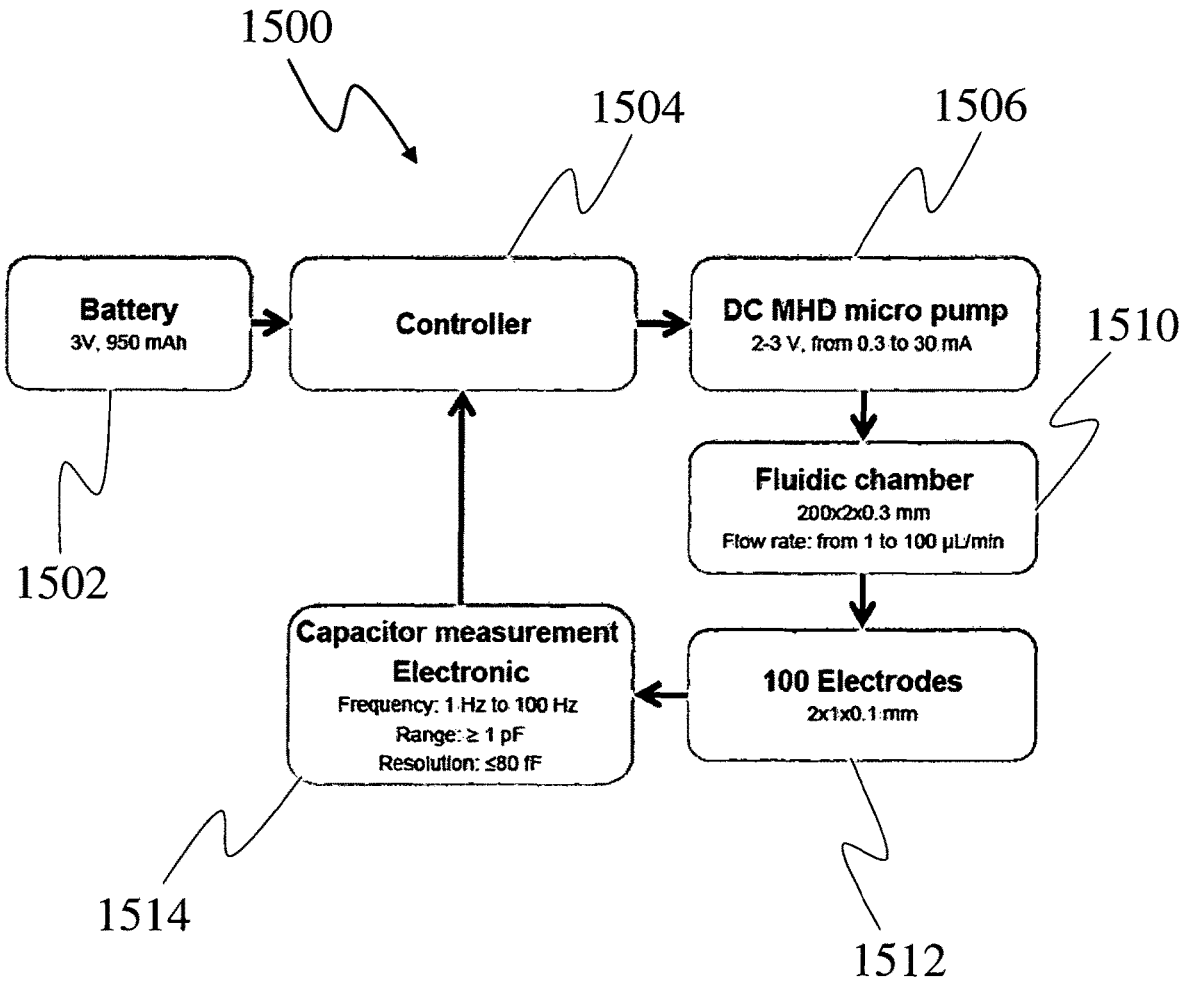
FIG. 15 is a schematic diagram of the feedback control system used to control the location of the meniscus or indicating drop.

Referring now to FIG. 15, a schematic diagram of the feedback control system 1500 used to control the location of the meniscus 1290, indicating drop 1410 of non-conductive fluid or other feature is shown. A battery 1502 supplies power to a controller 1504 which controls one or more DC MHD micro pump(s) 1506 in the fluid chamber 1510 in which a plurality of electrodes 1512, preferably 100 or more (to ensure good time resolution and control) are disposed. A capacitor measurement electronic system 1514 measures capacitance and sends the capacitance values for the plurality of electrodes 1512 to the controller 1504 as an input for processing.

Figure 16:
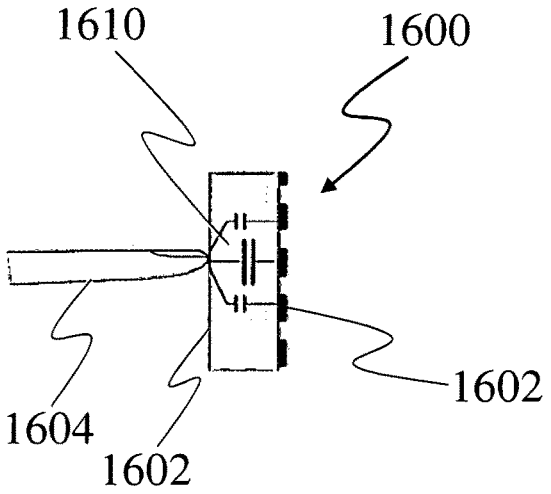
FIG. 16 is a schematic view of the function of a touch screen type capacitance sensor.
Figure 17A:
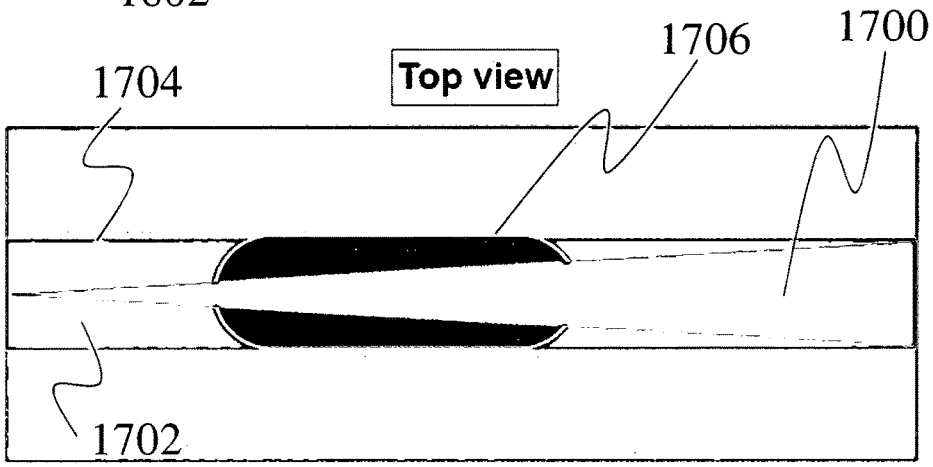
FIG. 17A and FIG. 17B are schematic views of a first arrangement of capacitance sensors used in the invention.
Figure 17B:
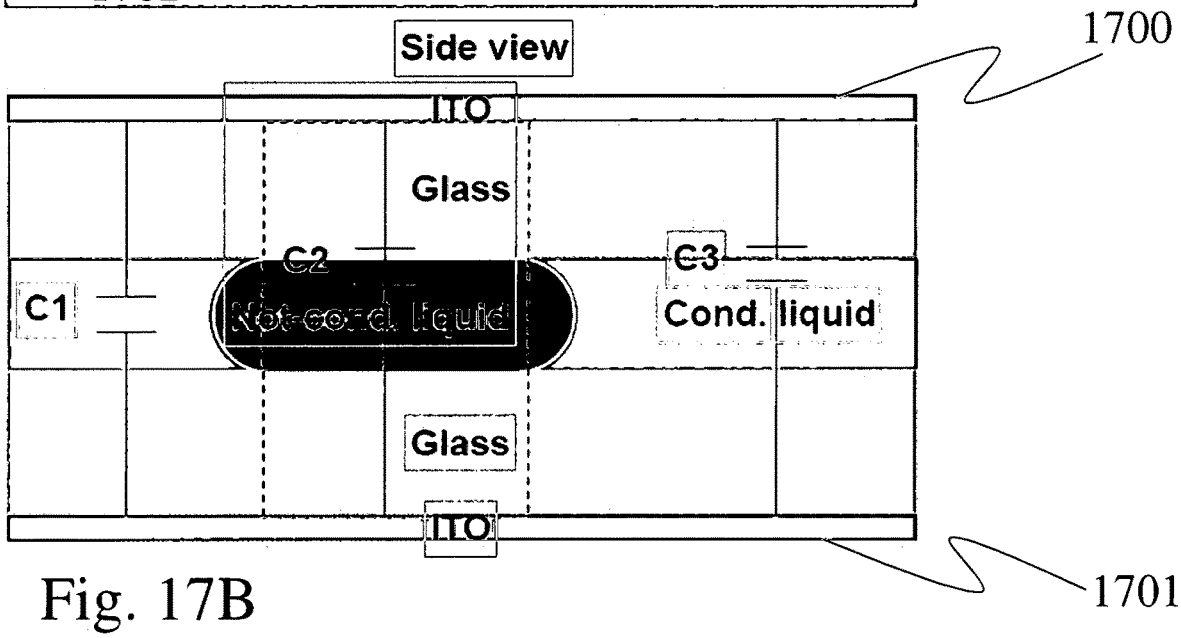

Referring now to FIG. 16, a schematic of the function of a touch screen type capacitance sensor 1600 is shown. A plurality of electrodes 1602 sense the change in capacitance caused by an object (such as a finger 1604) contacting a surface 1606 being along a dielectrical pathway 1610 to the electrodes or sensors 1602. In one embodiment, shown in FIG. 17A and FIG. 17B, a change in capacitance is detected by measuring capacitance of change in conductance between two triangular electrodes 1700, 1701 attached to walls 1702 of the fluidic chamber 1704. Such electrodes 1700 may be oriented perpendicular to the typical viewing angle of a user. Such electrodes 1700 can be ITO/FTO electrodes. As a function of the position of the non-conductive fluid 1706, the capacitor dielectric is modified (via modification of the surface covering the non-conductive fluid 1706), leading to a modification of the capacitance measured. Using an experimentally developed threshold, the location of the non-conductive fluid can be heuristically determined.

Figure 17C:
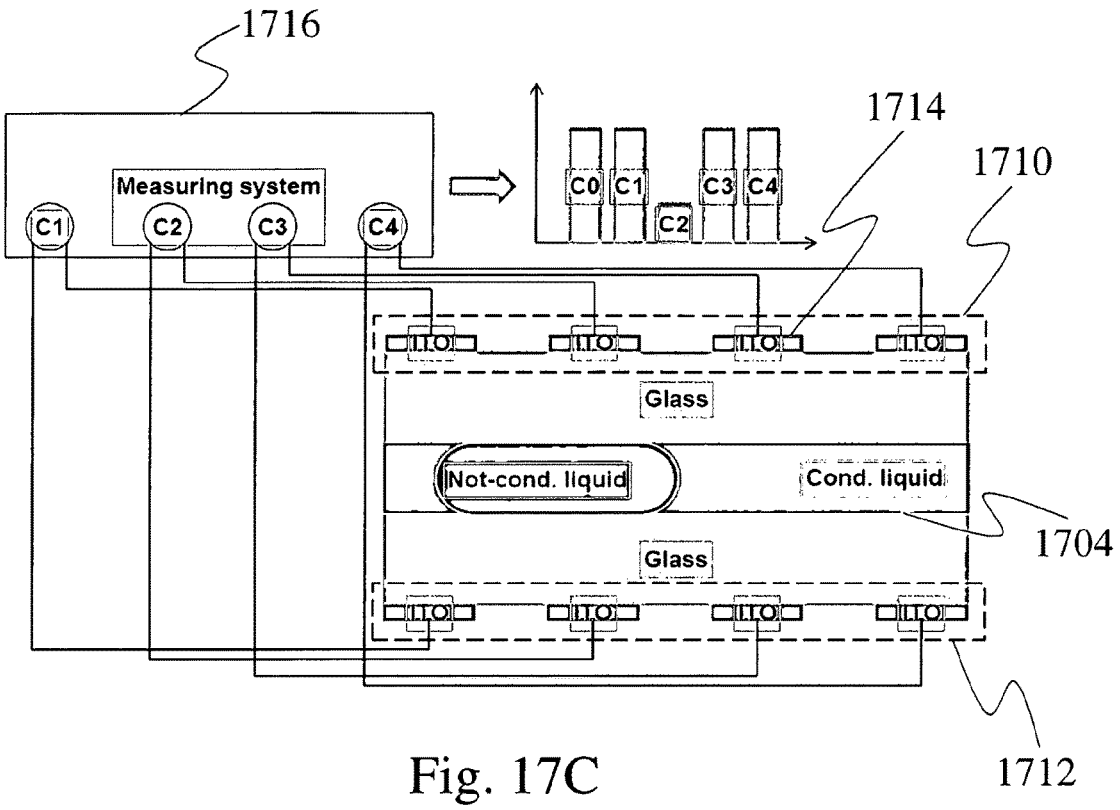
FIGS. 17C and 17D are schematic views of a second alternate arrangement of capacitance sensors used in the invention.
Figure 17D:
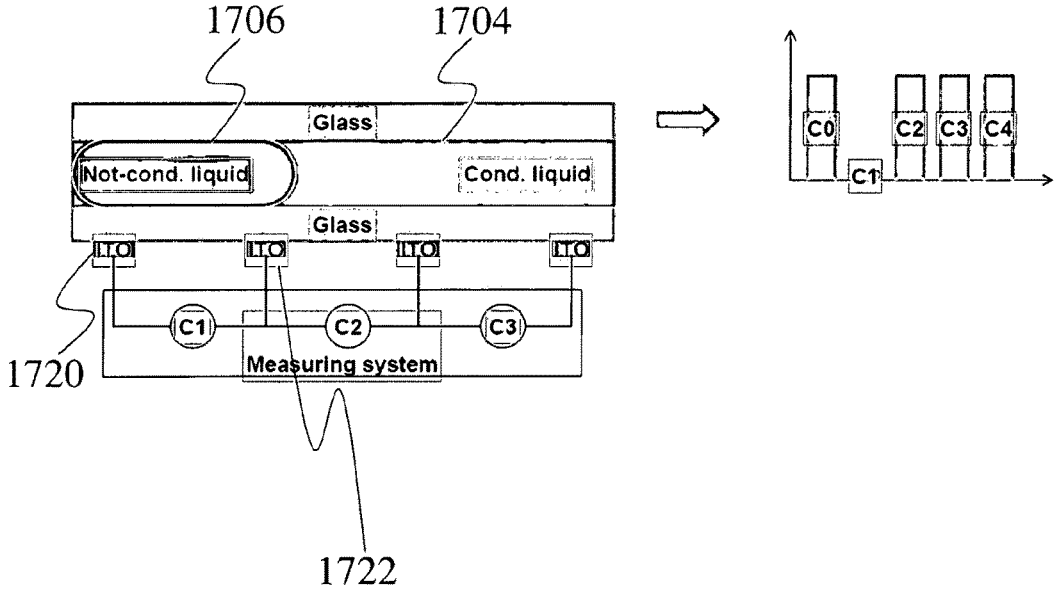

Referring now to FIGS. 17C and 17D, in an alternate embodiment, to detect the position of the non-conductive fluid 1706, capacitance is measured between two electrode matrices 1710, 1712 on both sides of the fluid chamber 1704. The electrodes 1714 are preferably ITO sensors. Such ITO sensors 1714 measure capacitance across the fluid chamber 1704 and the feedback loop to measuring system 1716 reads the capacitance C1, C2, C3, C4 etc., measured at each location along the matrix 1710. The low capacitance location C2 of the non-conductive fluid 1706 may then be identified by measurement and comparison.

Figure 17E:
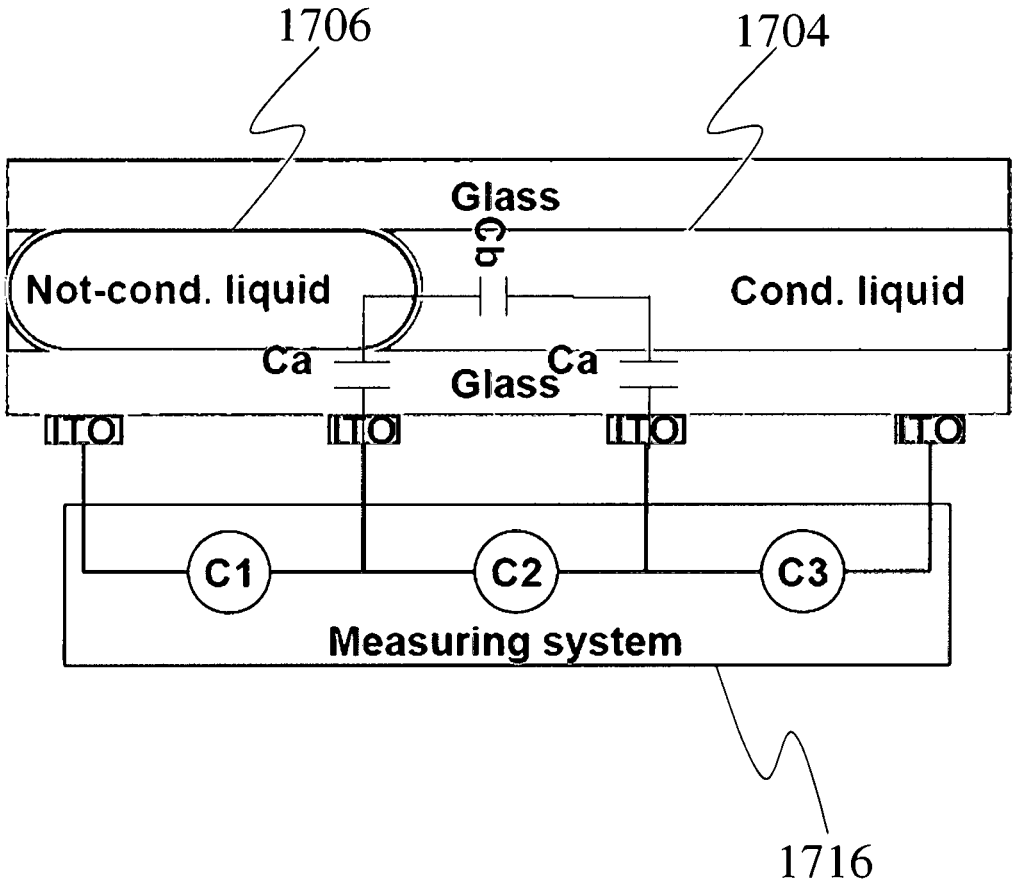
FIG. 17E is a schematic view of a third alternate arrangement of capacitance sensors used in the invention.

Referring now to FIG. 17E, in a further alternate embodiment, the position of the non-conducting fluid 1706 may be determined by measuring the capacitance between two adjacent electrodes 1720, 1722 or comparing the capacitance measures between two adjacent electrodes.

Companies such as Dalian HeptaChroma SolarTech Co., Ltd. of Dalian, China, and Thin Film Devices Incorporated of Anaheim, Calif. provide glass substrates with a deposition of ITO layer which may be suitable for applying the layer to the glass substrate of the indicator face. A suitable controller 1716 for the feedback control mechanism is available from Analog Devices Inc. of Norwood, Mass., with the model number AD7745, being of particular suitability as it is able to measure capacitance in a range of +/−4 pF with a resolution of +/−4 fF.

Figure 18A:
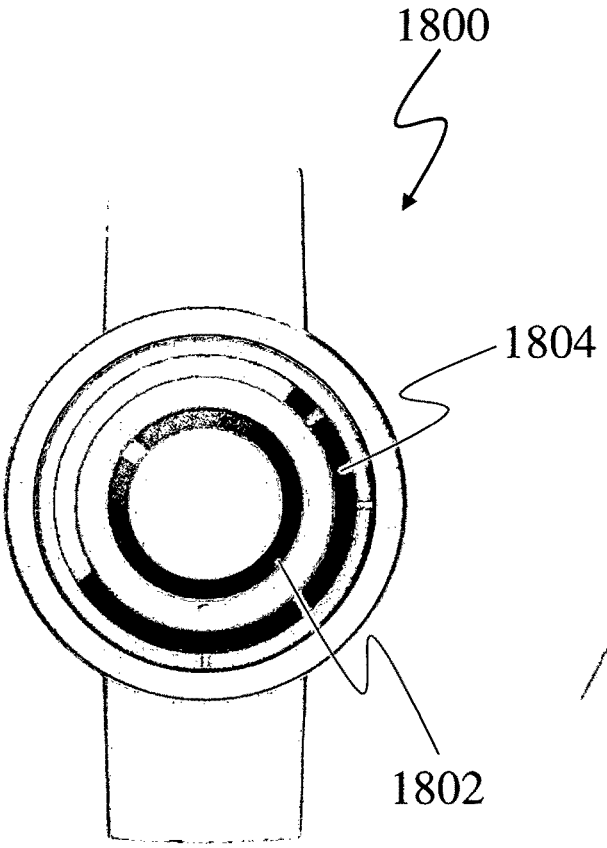
FIG. 18A is a top view of an example wristwatch using the system of the invention.
Figure 18B:
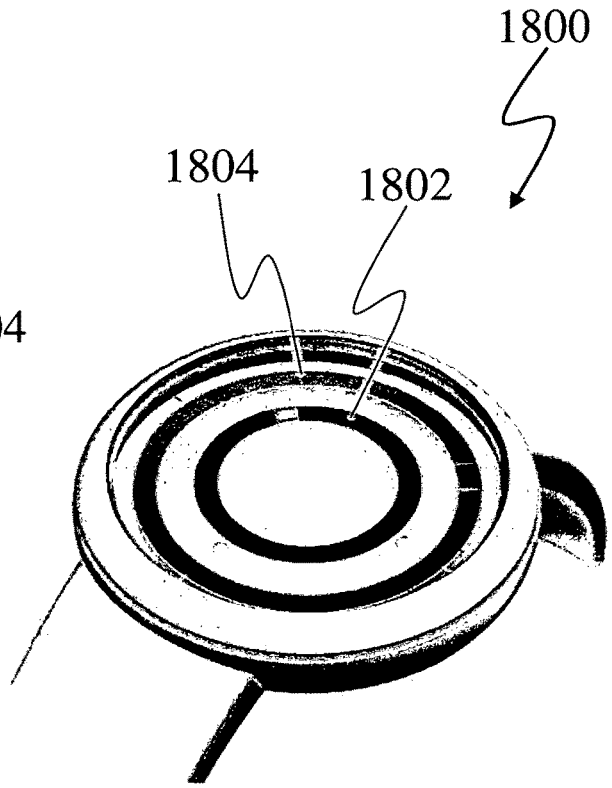
FIG. 18B is a perspective view of an example wristwatch using the system of the invention.

Referring now to FIGS. 18A and 18B, an example wristwatch 1800 using the system 100, 200, 300 of the invention is shown. Note that this example includes two separate fluidic control systems, one system having a display 1802 for the hours and one system having a display 1804 for the minutes.

Using ITO/FTO sensors, touch sensitivity may be exploited by enabling the setting the time to be simplified, as all that is required once a setting mode is activated, is to touch the location where the meniscus or non-conductive droplet should be located on the hour and/or minute display 1802, 1804, respectively. The change in capacitance is sensed in setting mode and the feedback loop controller is then operated to move the meniscus or droplet into the proper or desired position.

In addition, where a gas is used, because a gas cannot easily be colored or be made opaque, the contrast of the display is preferably modified such that the background surrounding the gas is dark so that the indication is clearly visible.

In an advantage, the system is a closed loop, having no or few moving parts, which better ensures its durability.

In another advantage, the accuracy of the system 100, 200, 300 is controlled by a feedback control system 1500 paced by a quartz movement, thereby compensating for a wide range of variables (temperature, viscosity, fluid flow issues) by actively controlling the location of the indicating feature, while maintaining accuracy when used as a time piece.

In another advantage, the system 100, 200, 300 eliminates the need for complex and expensive parts such as fluid bellows or a complex micro-pump.

In another advantage, the system 100, 200, 300 provides a fluid display for a jewelry item such as that developed and made fashionable by HYT SA of Switzerland while costing a fraction of the price.

The instant provisional patent application incorporates by reference in its entirety, as if fully set forth herein, U.S. patent application Ser. No. 61/787,727, filed on 15 Mar. 2013, and International patent application no. PCT/IB2014/000373, filed on 17 Mar. 2014, both entitled "TEMPERATURE DRIVEN WINDING SYSTEM".

As used herein, the terms "comprises", "comprising", or variations thereof, are intended to refer to a non-exclusive listing of elements, such that any apparatus, process, method, article, or composition of the invention that comprises a list of elements, that does not include only those elements recited, but may also include other elements described in the instant specification. Unless otherwise explicitly stated, the use of the term "consisting" or "consisting of" or "consisting essentially of" is not intended to limit the scope of the invention to the enumerated elements named thereafter, unless otherwise indicated. Other combinations and/or modifications of the above-described elements, materials or structures used in the practice of the present invention may be varied or adapted by the skilled artisan to other designs without departing from the general principles of the invention. The patents and articles mentioned above are hereby incorporated by reference herein, unless otherwise noted, to the extent that the same are not inconsistent with this disclosure.

Other characteristics and modes of execution of the invention are described in the appended claims. Further, the invention should be considered as comprising all possible combinations of every feature described in the instant specification, appended claims, and/or drawing figures which may be considered new, inventive and industrially applicable.

Additional features and functionality of the invention are described in the claims appended hereto. Such claims are hereby incorporated in their entirety by reference thereto in this specification and should be considered as part of the application as filed.

Multiple variations and modifications are possible in the embodiments of the invention described here. For example, the differing physical quantities measures are preferably resistivity or capacitance. However, other characteristics, such as transparency or viscosity might also be used as these can also be sensed by existing sensors. Transparency can be sensed by a light sensor sensing a pulse of light emitted from an LED passing through the fluids in the channel. Light sensors in an array along the channel can then be read to determine the location of the meniscus between two fluids having differing transparency. Viscosity can be sensed with a viscosity sensor such as by using a series of cantilever probes entering into the fluid chamber along its length, the probes having a piezo-resistor built into its base, by which the relative deflection can be measured and used to determine the location of a meniscus between two fluids of differing viscosity. Such a sensor is described in *Measurement and Evaluation of the Gas Density and Viscosity of Pure Gases and Mixtures Using a Micro-Cantilever Beam*, by Anastasios Badarlis, Axel Pfau and Anestis Kalfas, Laboratory of Fluid Mechanics and Turbomachinery, Aristotle University of Thessaloniki, Thessaloniki, Greece, *Sensors* 2015, 15(9), 24318-24342; such as available from Endress+Hauser Flowtec AG of Reinach, Switzerland. Still further, an MHD pump need not be used, thus eliminating the need of using the physical characteristic or property of the fluid to drive the fluids in the fluid channel. The above description, minus mention of MHD pumps (in which nano-pumps or micro-pumps are substituted therefore) and minus the mention of "conductive" in relation to the fluids discussed as a property needed for propulsion, is therefore repeated here again in its entirety in reference to the mentioned alternative pumps which do not require conductivity on the part of the fluid. Although certain illustrative embodiments of the invention using conductivity, resistivity, and capacitance have been shown and described here, a wide range of changes, modifications, and substitutions is contemplated in the foregoing disclosure. While the above description contains many specific details, these should not be construed as limitations on the scope of the invention, but rather exemplify one or another preferred embodiment thereof. In some instances, some features of the present invention may be employed without a corresponding use of the other features. Accordingly, it is appropriate that the foregoing description be construed broadly and understood as being illustrative only, the spirit and scope of the invention being limited only by the claims which ultimately issue in this application.

What is claimed is:

1. An indication device comprising an elongated fluid chamber containing at least two immiscible fluids, at least one of which has a characteristic physical property different from the other fluid and at least one fluid is a liquid driven by an at least one electrically activated pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a fixed feature location sensor which directly senses the different characteristic physical property of the fluids so as to localize the feature and a feedback controller which cooperate so as to activate the pump to move the feature to a desired location in the chamber in order to indicate to the observer.

2. The indication device of claim 1, wherein the feature location sensor uses measured differences in physical characteristics or properties across the chamber as an input which the feedback controller uses to activate the at least one pump which moves the location of the feature to the desired location.

3. The indication device of the claim 2, wherein conductance is the physical characteristic used to detect the position of segment of the at least one liquid, so as to enable control thereof.

4. The indication device of the claim 2, wherein capacitance is the physical characteristic used to detect the position of segment of the at least one liquid, so as to enable control thereof.

5. The indication device of claim 2, wherein resistivity is the physical characteristic used to detect the position of segment of the at least one liquid, so as to enable control thereof.

6. The indication device of claim 2, wherein relative viscosity is the physical characteristic used to detect the position of segment of the at least one liquid, so as to enable control thereof.

7. The indication device of claim 1, wherein the feature is a meniscus.

8. The indication device of claim 1, wherein the feature is a bubble or bubble surface.

9. The indication device of claim 1, wherein the feature is an object suspended in a fluid or between fluids in the chamber.

10. The indication device of claim 1, wherein at least one liquid is a colored liquid.

11. The indication device of claim 1 in which the at least one liquid has the same refractive index as the rigid chamber.

12. The indication device of claim 1, wherein the at least one liquid has a suspended particulate visible to the observer.

13. The indication device of claim 1, wherein the direction of motion of the fluids are changed by changing the polarity of the at least one pump.

14. The indication device of claim 1, wherein reversal of operation of the pump reverses fluid flow in the chamber.

15. The indication device of claim 1, wherein the quantity indicated is time.

16. The indication device of claim 1 wherein the indication device is a watch.

17. The indication device of claim 1, wherein the elongated chamber is linear in form in portions thereof.

18. The indication device of claim 1, wherein the elongated chamber is nonlinear in form.

19. The indication device of claim 18, wherein the elongated chamber is circular.

20. An indication device of claim 1 wherein at least two pumps are disposed along the elongated chamber so as to ensure that at any operational position of the liquid, the liquid can be pumped.

21. The indication device of claim 1, wherein the direction of motion of the fluids are changed by changing the polarity of the at least one pump.

22. The indication device of claim 1, wherein reversal of operation of the pump reverses fluid flow in the chamber.

23. An indication device comprising an elongated fluid chamber containing at least two immiscible fluids, at least one of which has a characteristic physical property different from the other fluid and at least one fluid is a liquid driven by an at least one electrically activated pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a feature location sensor which senses the different characteristic physical property of the fluids so as to localize the feature and a feedback controller which cooperate so as to activate the pump to move the feature to a desired location in the chamber in order to indicate to the observer wherein relative transparency is the physical characteristic used to detect the position of segment of the at least one liquid, so as to enable control thereof.

24. An indication device comprising an elongated fluid chamber containing at least two immiscible fluids, at least one of which has a characteristic physical property different from the other fluid and at least one fluid is a liquid driven by an at least one electrically activated pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a feature location sensor which senses the different characteristic physical property of the fluids so as to localize the feature and a feedback controller which cooperate so as to activate the pump to move the feature to a desired location in the chamber in order to indicate to the observer, wherein a conductivity sensitive film is the feature location sensor.

25. The indication device of claim 24 in which the at least one liquid has the same refractive index as the rigid chamber.

26. An indication device comprising an elongated fluid chamber containing at least two immiscible fluids, at least one of which has a characteristic physical property different from the other fluid and at least one fluid is a liquid driven by an at least one electrically activated pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a feature location sensor which senses the different characteristic physical property of the fluids so as to localize the feature and a feedback controller which cooperate so as to activate the pump to move the feature to a desired location in the chamber in order to indicate to the observer, wherein the elongated fluid chamber is essentially an endless closed loop.

27. The indication device of claim 26 in which the at least one liquid has the same refractive index as the rigid chamber.

28. An indication device comprising an elongated fluid chamber containing at least two immiscible fluids, at least one of which has a characteristic physical property different from the other fluid and at least one fluid is a liquid driven by an at least one electrically activated pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a feature location sensor which senses the different characteristic physical property of the fluids so as to localize the feature and a feedback controller which cooperate so as to activate the pump to move the feature to a desired location in the chamber in order to indicate to the observer, wherein the at least one liquid is enclosed in the elongated chamber of a closed loop that has at least one exposed, at least partially transparent surface allowing the observer to observe the position of the at least one feature of the liquid, the indication device further comprising a mechanism accommodating thermal expansion and/or contraction of the fluids, the mechanism disposed so as to be substantially invisible to the observer, wherein the mechanism accommodating thermal expansion or contraction is selected from one of a group of mechanisms consisting of a thin and flexible wafer enclosing the chamber in an airtight and watertight manner and disposed out of the field of view of the observer, a separate gas-filled chamber disposed out of the field of view of the observer, and a soft flexible material disposed in a portion of the chamber which is out of the field of view of the observer.

29. The indication device of the claim 28, wherein the mechanism accommodating thermal expansion and/or contraction is a gas-filled indicator bubble in the at least one liquid.

30. The indication device of claim 28, wherein the mechanism accommodating thermal expansion or contraction is selected from one of a group of mechanisms consisting of a thin and flexible wafer enclosing the chamber in an airtight and watertight manner and disposed out of the field of view of the observer, a separate gas-filled chamber disposed out of the field of view of the observer, and a soft flexible material disposed in a portion of the chamber which is out of the field of view of the observer.

31. The indication device of claim 28, wherein the mechanism accommodating thermal expansion and/or contraction is a gas-filled chamber portion of the rigid chamber, located out of the field of view of the observer, and connected to the liquid-filled portion of the rigid chamber by a passageway portion of the rigid chamber.

32. The indication device of claim 28 in which the at least one liquid has the same refractive index as the rigid chamber.

33. An indication device comprising an elongated fluid chamber containing at least two immiscible fluids, at least one of which has a characteristic physical property different from the other fluid and at least one fluid is a liquid driven by an at least one pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a fixed feature location sensor which directly senses the different characteristic physical property of the fluids so as to localize the feature and a feedback controller which cooperate so as to activate the pump to move the feature to a desired location in the chamber in order to indicate to the observer, and wherein the chamber is formed by two or more material wafers of differing forms connected to each other.

34. The indication device of claim 33, wherein the material wafers are glass wafers.

35. The indication device of claim 33, wherein the chamber is formed by a polymer.

36. The indication device of claim 35, wherein the chamber is formed by injection molding of the polymer.

37. The indication device of claim 33, wherein the two or more material wafers of differing forms are connected to each other by bonding.

38. An indication device comprising an elongated fluid chamber containing at least two immiscible fluids, at least one of which has a characteristic physical property different from the other fluid and at least one fluid is a liquid driven by an at least one electrically activated pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a fixed feature location sensor which directly senses the different characteristic physical property of the fluids so as to localize the feature and a feedback controller which cooperate so as to activate the pump to move the feature to a desired location in the chamber in order to indicate to the observer, and wherein the at least one pump is disposed along the elongated chamber so as to ensure that at any operational position of the liquid, the liquid can be pumped.

39. An indication device of claim 38 wherein reversal of the operation of the pump reverses fluid flow in the chamber.

40. An indication device comprising an elongated fluid chamber containing at least two immiscible fluids, at least one of which has a characteristic physical property different from the other fluid and at least one fluid is a liquid driven by an at least one electrically activated pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a feature location sensor which senses the different characteristic physical property of the fluids so as to localize the feature and a feedback controller which cooperate so as to activate the pump to move the feature to a desired location in the chamber in order to indicate to the observer, wherein at least one of the at least two immiscible fluids is an electrically conducting liquid driven by the pump and the other is an immiscible, relatively non-conductive fluid, the indication device further including a feature location sensor and a feedback controller which cooperate so as to move the feature to a desired location in the chamber in order to indicate a quantity to the observer.

41. The indication device of claim 40 in which the at least one liquid has the same refractive index as the rigid chamber.

42. An indication device comprising an elongated fluid chamber containing at least two immiscible fluids, at least one of which has a characteristic physical property different from the other fluid and at least one fluid is a liquid driven by an at least one electrically activated pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a feature location sensor which senses the different characteristic physical property of the fluids so as to localize the feature and a feedback controller which cooperate so as to activate the pump to move the feature to a desired location in the chamber in order to indicate to the observer, wherein the at least one pump is an MHD pump.

43. The indication device of claim 42 in which the at least one liquid has the same refractive index as the rigid chamber.

44. An indication device comprising an elongated fluid chamber containing at least two immiscible fluids, at least one of which has a characteristic physical property different from the other fluid and at least one fluid is a liquid driven by an at least one electrically activated pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a feature location sensor and a feedback controller which cooperate so as to activate the pump to move the feature to a desired location in the chamber in order to indicate to the observer, wherein the feature location sensor uses measured differences in physical characteristics or properties across the chamber as an input which the feedback controller uses to activate the at least one pump which moves the location of the feature to the desired location, and wherein further relative transparency is the physical characteristic used to detect the position of segment of the at least one liquid, so as to enable control thereof.

45. The indication device of claim 44, wherein the feature is a meniscus.

46. The indication device of claim 44, wherein the feature is a bubble or bubble surface.

47. The indication device of claim 44, wherein the feature is an object suspended in a fluid or between fluids in the chamber.

48. The indication device of claim 44, wherein at least one liquid is a colored liquid.

49. The indication device of claim 44 in which the at least one liquid has the same refractive index as the rigid chamber.

50. The indication device of claim 44, wherein the at least one liquid has a suspended particulate visible to the observer.

51. An indication device comprising an elongated fluid chamber containing at least two immiscible fluids, at least one of which has a characteristic physical property different from the other fluid and at least one fluid is a liquid driven by an at least one electrically activated pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a feature location sensor and a feedback controller which cooperate so as to activate the pump to move the feature to a desired location in the chamber in order to indicate to the observer, wherein the feature location sensor uses measured differences in physical characteristics or properties across the chamber as an input which the feedback controller uses to activate the at least one pump which moves the location of the feature to the desired location, and wherein further relative viscosity is the physical characteristic used to detect the position of segment of the at least one liquid, so as to enable control thereof.

52. The indication device of claim 51, wherein the feature is a meniscus.

53. The indication device of claim 51, wherein the feature is a bubble or bubble surface.

54. The indication device of claim 51, wherein the feature is an object suspended in a fluid or between fluids in the chamber.

55. The indication device of claim 51, wherein at least one liquid is a colored liquid.

56. The indication device of claim 51 in which the at least one liquid has the same refractive index as the rigid chamber.

57. The indication device of claim 51, wherein the at least one liquid has a suspended particulate visible to the observer.

58. The indication device of claim 51, wherein the direction of motion of the fluids are changed by changing the polarity of the at least one pump.

59. The indication device of claim 51, wherein reversal of operation of the pump reverses fluid flow in the chamber.

60. An indication device comprising an elongated fluid chamber containing at least two immiscible fluids, at least one of which has a characteristic physical property different from the other fluid and at least one fluid is a liquid driven by an at least one electrically activated pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a fixed feature location sensor which directly senses the different characteristic physical property of the fluids and a feedback controller which cooperate so as to activate the pump to move the feature to a desired location in the chamber in order to indicate to the observer, wherein a conductivity sensitive film is the feature location sensor.

61. The indication device of claim 60, wherein the feature is a meniscus.

62. The indication device of claim 60, wherein the feature is a bubble or bubble surface.

63. The indication device of claim 60, wherein the feature is an object suspended in a fluid or between fluids in the chamber.

64. The indication device of claim 60, wherein at least one liquid is a colored liquid.

65. The indication device of claim 60 in which the at least one liquid has the same refractive index as the rigid chamber.

66. The indication device of claim 60, wherein the at least one liquid has a suspended particulate visible to the observer.

67. The indication device of claim 60, wherein the direction of motion of the fluids are changed by changing the polarity of the at least one pump.

68. The indication device of claim 60, wherein reversal of operation of the pump reverses fluid flow in the chamber.

69. An indication device comprising an elongated fluid chamber containing at least two immiscible fluids, at least one of which has a characteristic physical property different from the other fluid and at least one fluid is a liquid driven by an at least one electrically activated pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a feature location sensor and a feedback controller which cooperate so as to activate the pump to move the feature to a desired location in the chamber in order to indicate to the observer, wherein the elongated fluid chamber is an endless closed loop.

70. An indication device comprising an elongated fluid chamber containing at least two immiscible fluids, at least one of which has a characteristic physical property different from the other fluid and at least one fluid is a liquid driven by an at least one electrically activated pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a feature location sensor and a feedback controller which cooperate so as to activate the pump to move the feature to a desired location in the chamber in order to indicate to the observer, and wherein the at least one liquid is enclosed in the elongated chamber of a closed loop that has at least one exposed, at least partially transparent surface allowing the observer to observe the position of the at least one feature of the liquid, the indication device further comprising a mechanism accommodating thermal expansion and/or contraction of the fluids, the mechanism disposed so as to be substantially invisible to the observer, wherein the mechanism accommodating thermal expansion or contraction is selected from one of a group of mechanisms consisting of a thin and flexible wafer enclosing the chamber in an airtight and watertight manner and disposed out of the field of view of the observer, a separate gas-filled chamber disposed out of the field of view of the observer, and a soft flexible material disposed in a portion of the chamber which is out of the field of view of the observer.

71. The indication device of the claim 70, wherein the mechanism accommodating thermal expansion and/or contraction is a gas-filled indicator bubble in the at least one liquid.

72. The indication device of claim 70, wherein the mechanism accommodating thermal expansion or contraction is selected from one of a group of mechanisms consisting of a thin and flexible wafer enclosing the chamber in an airtight and watertight manner and disposed out of the field of view of the observer, a separate gas-filled chamber disposed out of the field of view of the observer, and a soft flexible material disposed in a portion of the chamber which is out of the field of view of the observer.

73. The indication device of claim 70, wherein the mechanism accommodating thermal expansion and/or contraction is a gas-filled chamber portion of the rigid chamber, located out of the field of view of the observer, and connected to the liquid-filled portion of the rigid chamber by a passageway portion of the rigid chamber.

74. An indication device comprising an elongated fluid chamber containing at least two immiscible fluids, at least one of which has a characteristic physical property different from the other fluid and at least one fluid is a liquid driven by an at least one electrically activated pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a fixed feature location sensor and a feedback controller which cooperate so as to activate the pump to move the feature to a desired location in the chamber in order to indicate to the observer, wherein at least one of the at least two immiscible fluids is an electrically conducting liquid driven by the pump and the other is an immiscible, relatively nonconductive fluid, the indication device further including a feedback controller which cooperate so as to move the feature to a desired location in the chamber in order to indicate a quantity to the observer.

75. An indication device comprising an elongated fluid chamber containing at least two immiscible fluids, at least one of which has a characteristic physical property different from the other fluid and at least one fluid is a liquid driven by an at least one electrically activated pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a fixed feature location sensor and a feedback controller which cooperate so as to activate the pump to move the feature to a desired location in the chamber in order to indicate to the observer, wherein the at least one pump is an MHD pump.

76. The indication device of claim 75, wherein the feature is a meniscus.

77. The indication device of claim 75, wherein the feature is a bubble or bubble surface.

78. The indication device of claim 75, wherein the feature is an object suspended in a fluid or between fluids in the chamber.

79. The indication device of claim 75, wherein at least one liquid is a colored liquid.

80. The indication device of claim 75 in which the at least one liquid has the same refractive index as the rigid chamber.

81. The indication device of claim 75, wherein the at least one liquid has a suspended particulate visible to the observer.

82. The indication device of claim 75, wherein the direction of motion of the fluids are changed by changing the polarity of the at least one pump.

83. The indication device of claim 75, wherein reversal of operation of the pump reverses fluid flow in the chamber.

84. An indication device comprising an elongated fluid chamber containing at least two immiscible fluids, at least one of which has a characteristic physical property different from the other fluid and at least one fluid is a liquid driven by an at least one electrically activated pump, wherein at least one feature of the liquid contained in the chamber is used as an indicator, which feature the at least one pump drives along the chamber either directly or indirectly, via another fluid in the chamber, along adjacent indices of an indicator visible to an observer, the indication device further including a fixed feature location sensor which directly senses the different characteristic physical property of the fluids so as to localize the feature, the feature location sensor comprising a conductivity sensitive film, so as to localize the feature and a feedback controller which cooperate so as to activate the pump to move the feature to a desired location in the chamber in order to indicate to the observer.

* * * * *